US011638465B2

(12) United States Patent
Rushbrook et al.

(10) Patent No.: US 11,638,465 B2
(45) **Date of Patent: *May 2, 2023**

(54) FOOTWEAR HAVING MOTORIZED ADJUSTMENT SYSTEM AND ELASTIC UPPER

(71) Applicant: NIKE, Inc., Beaverton, OR (US)

(72) Inventors: Thomas J. Rushbrook, Portland, OR (US); Tiffany A. Beers, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 107 days.

This patent is subject to a terminal disclaimer.

(21) Appl. No.: 16/939,328

(22) Filed: Jul. 27, 2020

(65) Prior Publication Data

US 2020/0352283 A1 Nov. 12, 2020

Related U.S. Application Data

(63) Continuation of application No. 16/518,006, filed on Jul. 22, 2019, now Pat. No. 11,219,276, which is a (Continued)

(51) Int. Cl.
*A43C 11/16* (2006.01)
*A43C 11/22* (2006.01)

(Continued)

(52) U.S. Cl.
CPC ..... *A43C 11/165* (2013.01); *A43B 3/34* (2022.01); *A43B 5/001* (2013.01); *A43B 5/002* (2013.01);

(Continued)

(58) Field of Classification Search
CPC ... A43C 11/165; A43C 11/002; A43C 11/008; A43C 11/22; A43C 1/00; A43C 1/06;

(Continued)

(56) References Cited

U.S. PATENT DOCUMENTS 697,590 A * 4/1902 Wright ..... A43B 23/047 36/51
1,702,583 A 2/1929 Isiah (Continued)

FOREIGN PATENT DOCUMENTS

CN 101686739 A 3/2010
CN 202311395 U 7/2012

(Continued)

OTHER PUBLICATIONS

"U.S. Appl. No. 16/518,006, Supplemental Notice of Allowability dated Dec. 9, 2021", 2 pgs.

(Continued)

*Primary Examiner* — Bao-Thieu L Nguyen
(74) *Attorney, Agent, or Firm* — Schwegman, Lundberg & Woessner, P.A.

(57) ABSTRACT

An article of footwear may include an upper configured to receive a foot of a wearer, the upper including one or more elastic portions and one or more substantially inelastic portions. The footwear may further include a plurality of lace receiving members fixedly attached to an outer surface of the upper on the inelastic portions of the upper. Also, the footwear may include a sole structure fixedly attached to the upper. In addition, the footwear may include a motorized tensioning system including a motorized tightening device and a tensile member extending through the plurality of lace receiving members, the tightening device being configured to apply tension in the tensile member to adjust the size of an internal void defined by the article of footwear by drawing two or more of the plurality of lace receiving members closer to one another.

27 Claims, 19 Drawing Sheets

Related U.S. Application Data continuation of application No. 15/488,158, filed on Apr. 14, 2017, now Pat. No. 10,376,018, which is a continuation of application No. 14/253,055, filed on Apr. 15, 2014, now Pat. No. 9,629,418.

(51) Int. Cl.

| | |
|---|---|
| ***A43B 11/00*** | (2006.01) |
| ***A43B 23/02*** | (2006.01) |
| ***A43B 23/04*** | (2006.01) |
| ***A43C 1/06*** | (2006.01) |
| ***A43C 3/00*** | (2006.01) |
| ***A43C 11/00*** | (2006.01) |
| ***A43B 3/34*** | (2022.01) |
| ***A43B 5/00*** | (2022.01) |
| ***A43B 5/02*** | (2006.01) |
| ***A43B 5/06*** | (2022.01) |
| ***A43B 9/02*** | (2006.01) |
| ***A43B 9/12*** | (2006.01) |
| ***A43C 1/00*** | (2006.01) |

(52) U.S. Cl.

CPC ..... *A43B 5/02* (2013.01); *A43B 5/06* (2013.01); *A43B 9/02* (2013.01); *A43B 9/12* (2013.01); *A43B 11/00* (2013.01); *A43B 23/027* (2013.01); *A43B 23/0275* (2013.01); *A43B 23/0295* (2013.01); *A43B 23/047* (2013.01); *A43C 1/00* (2013.01); *A43C 1/06* (2013.01); *A43C 3/00* (2013.01); *A43C 11/002* (2013.01); *A43C 11/008* (2013.01); *A43C 11/22* (2013.01)

(58) Field of Classification Search

CPC .. A43C 3/00; A43B 3/34; A43B 5/001; A43B 5/002; A43B 5/02; A43B 5/06; A43B 9/12; A43B 9/02; A43B 11/00; A43B 23/027; A43B 23/0275; A43B 23/0295; A43B 23/047

See application file for complete search history.

(56) References Cited

U.S. PATENT DOCUMENTS 1,916,483 A 7/1933 Ora
3,187,342 A 6/1965 Aileo
3,430,303 A 3/1969 Perrin et al.
3,549,878 A 12/1970 Bailey
3,859,496 A 1/1975 Giese
4,011,634 A 3/1977 Olivieri
4,020,571 A 5/1977 Olivieri
4,037,333 A 7/1977 Olivieri
4,090,278 A 5/1978 Olivieri
4,130,949 A 12/1978 Seidel
4,253,217 A 3/1981 Marzocchi
4,310,951 A 1/1982 Riedel
4,326,320 A 4/1982 Riedel
4,424,636 A 1/1984 Everest
4,433,456 A 2/1984 Baggio
4,453,290 A 6/1984 Riedel
4,616,432 A * 10/1986 Bunch ..... A43C 1/003 36/114
4,619,057 A 10/1986 Sartor et al.
4,654,985 A * 4/1987 Chalmers ..... A43B 3/0084 36/118.2
4,697,360 A 10/1987 Sartor
4,724,626 A 2/1988 Baggio
4,741,115 A 5/1988 Pozzobon
4,780,968 A 11/1988 Bragagnoio
4,787,124 A 11/1988 Pozzobon et al.
4,800,659 A 1/1989 Marega
4,802,290 A 2/1989 Marega
4,817,303 A * 4/1989 Selbiger ..... A43C 1/00 36/51
4,841,649 A 6/1989 Baggio et al.
4,942,678 A 7/1990 Gumbert
5,105,566 A 4/1992 Legon
5,129,130 A 7/1992 Lecouturier
5,184,378 A * 2/1993 Batra ..... A43C 1/04 24/714.8
5,341,583 A 8/1994 Hallenbeck
5,377,430 A * 1/1995 Hatfield ..... A43B 3/08 36/51
5,379,532 A * 1/1995 Seidel ..... A43B 5/0447 36/118.1
5,381,609 A 1/1995 Hieblinger
5,425,185 A 6/1995 Gansler
5,456,393 A 10/1995 Mathis et al.
5,467,537 A * 11/1995 Aveni ..... A43C 11/00 24/712.1
5,469,640 A 11/1995 Nichols
5,495,682 A 3/1996 Chen
5,555,650 A 9/1996 Longbottom et al.
5,692,324 A 12/1997 Goldston et al.
5,755,044 A 5/1998 Veylupek
5,791,068 A 8/1998 Bernier et al.
5,836,899 A 11/1998 Reilly
5,839,210 A 11/1998 Bernier et al.
5,934,599 A * 8/1999 Hammerslag ..... A43C 11/00 242/396.2
6,018,890 A 2/2000 Bowen
6,032,387 A 3/2000 Johnson
6,052,924 A 4/2000 Sabat
6,148,489 A 11/2000 Dickie et al.
6,202,953 B1 3/2001 Hammerslag
6,289,558 B1 * 9/2001 Hammerslag ..... A43C 11/004 36/50.5
6,289,609 B1 9/2001 Bowen
6,305,103 B1 * 10/2001 Camargo ..... A43C 1/06 36/97
6,427,361 B1 * 8/2002 Chou ..... A43C 11/008 36/138
6,449,878 B1 9/2002 Lyden
6,601,042 B1 7/2003 Lyden
6,643,954 B2 * 11/2003 Voswinkel ..... A43B 21/42 36/138
6,681,504 B2 1/2004 Kinan
6,691,443 B1 2/2004 Slayden
6,751,490 B2 6/2004 Esenaliev et al.
6,807,754 B2 * 10/2004 Miller ..... A63C 17/0086 36/97
6,862,820 B2 3/2005 Farys et al.
6,892,429 B2 5/2005 Sartor
6,922,917 B2 * 8/2005 Kerns ..... A43B 5/14 36/50.1
7,065,906 B2 6/2006 Jones et al.
7,200,957 B2 4/2007 Hubbard et al.
7,287,342 B2 10/2007 Keen
7,331,126 B2 * 2/2008 Johnson ..... A43B 11/00 36/118.1
7,367,522 B2 5/2008 Chen
7,503,131 B2 3/2009 Nadel et al.
7,584,528 B2 9/2009 Hu
7,591,050 B2 9/2009 Hammerslag
7,661,205 B2 * 2/2010 Johnson ..... A43C 11/16 36/50.1
7,676,960 B2 3/2010 Dibenedetto et al.
7,721,468 B1 5/2010 Johnson et al.
7,752,774 B2 * 7/2010 Ussher ..... A43C 11/165 36/138
7,950,112 B2 5/2011 Hammerslag et al.
7,954,204 B2 6/2011 Hammerslag et al.
7,980,009 B2 7/2011 Carnes et al.
7,992,261 B2 8/2011 Hammerslag et al.
8,020,320 B2 9/2011 Gillespie
8,046,937 B2 11/2011 Beers et al.
8,056,269 B2 11/2011 Beers et al.
8,061,061 B1 11/2011 Rivas
8,074,379 B2 12/2011 Robinson et al.
8,091,182 B2 1/2012 Hammerslag et al.

(56) References Cited

U.S. PATENT DOCUMENTS

| | | | | |
|---|---|---|---|---|
| 8,141,277 | B2 | 3/2012 | Robinson et al. | |
| 8,151,490 | B2 | 4/2012 | Sokolowski | |
| 8,231,074 | B2 | 7/2012 | Hu et al. | |
| 8,387,282 | B2 | 3/2013 | Baker et al. | |
| 8,904,672 | B1 * | 12/2014 | Johnson | A43B 11/00 36/58.6 |
| 8,904,673 | B2 * | 12/2014 | Johnson | A43C 1/00 36/58.6 |
| 9,629,418 | B2 * | 4/2017 | Rushbrook | A43B 9/12 |
| 10,376,018 | B2 * | 8/2019 | Rushbrook | A43B 23/027 |
| 11,103,030 | B2 * | 8/2021 | Bock | A43B 3/36 |
| 11,219,276 | B2 * | 1/2022 | Rushbrook | A43B 5/002 |
| 2002/0007570 | A1 * | 1/2002 | Girard | A43B 23/0235 36/11.5 |
| 2002/0043007 | A1 | 4/2002 | Hannah et al. | |
| 2002/0095750 | A1 | 7/2002 | Hammerslag | |
| 2003/0131496 | A1 * | 7/2003 | Nakano | A43B 5/08 36/50.1 |
| 2004/0128863 | A1 | 7/2004 | Hong et al. | |
| 2004/0134099 | A1 * | 7/2004 | Jones | A43C 11/008 36/50.1 |
| 2005/0098673 | A1 | 5/2005 | Huang | |
| 2005/0102861 | A1 | 5/2005 | Martin | |
| 2005/0126043 | A1 * | 6/2005 | Reagan | A43C 1/06 36/50.1 |
| 2006/0000116 | A1 | 1/2006 | Brewer | |
| 2006/0005429 | A1 * | 1/2006 | Min | A43C 1/003 36/50.1 |
| 2006/0116483 | A1 | 6/2006 | Tonkel | |
| 2006/0156517 | A1 * | 7/2006 | Hammerslag | A43C 11/00 24/68 SK |
| 2006/0201031 | A1 | 9/2006 | Jones et al. | |
| 2007/0000105 | A1 | 1/2007 | Grande et al. | |
| 2007/0011914 | A1 | 1/2007 | Keen et al. | |
| 2007/0043630 | A1 | 2/2007 | Lyden | |
| 2007/0068040 | A1 * | 3/2007 | Farys | A43C 1/04 36/50.1 |
| 2007/0169378 | A1 | 7/2007 | Sodeberg et al. | |
| 2007/0260421 | A1 * | 11/2007 | Berner | A43B 3/0031 702/155 |
| 2007/0278911 | A1 | 12/2007 | Vallance et al. | |
| 2008/0060167 | A1 * | 3/2008 | Hammerslag | A43C 11/165 24/714.6 |
| 2008/0066272 | A1 | 3/2008 | Hammerslag | |
| 2008/0066346 | A1 * | 3/2008 | Hammerslag | A43C 11/165 36/50.1 |
| 2008/0083135 | A1 | 4/2008 | Hammerslag et al. | |
| 2008/0222917 | A1 | 9/2008 | Dojan et al. | |
| 2008/0235990 | A1 | 10/2008 | Wegener | |
| 2008/0307673 | A1 * | 12/2008 | Johnson | A43C 11/165 36/50.1 |
| 2009/0055044 | A1 | 2/2009 | Dienst | |
| 2009/0184189 | A1 | 7/2009 | Soderberg et al. | |
| 2009/0205221 | A1 | 8/2009 | Mitchell | |
| 2010/0101116 | A1 | 4/2010 | Serafino et al. | |
| 2010/0139057 | A1 | 6/2010 | Soderberg et al. | |
| 2010/0251524 | A1 | 10/2010 | Chen | |
| 2010/0299959 | A1 | 12/2010 | Hammerslag et al. | |
| 2011/0175744 | A1 | 7/2011 | Englert et al. | |
| 2011/0225843 | A1 | 9/2011 | Kerns et al. | |
| 2011/0258876 | A1 | 10/2011 | Baker et al. | |
| 2011/0266384 | A1 | 11/2011 | Goodman et al. | |
| 2012/0000091 | A1 | 1/2012 | Cotterman et al. | |
| 2012/0004587 | A1 | 1/2012 | Nickel et al. | |
| 2012/0005923 | A1 | 1/2012 | Beers et al. | |
| 2012/0011744 | A1 * | 1/2012 | Bell | A43B 19/00 36/91 |
| 2012/0117821 | A1 | 5/2012 | Adams et al. | |
| 2012/0144700 | A1 * | 6/2012 | Zhao | A43C 7/00 36/99 |
| 2012/0174433 | A1 * | 7/2012 | Mahoney | A43B 13/141 36/28 |
| 2012/0192457 | A1 | 8/2012 | Youngs | |
| 2013/0086816 | A1 * | 4/2013 | Johnson | A43C 1/00 36/83 |
| 2013/0104429 | A1 * | 5/2013 | Torres | A43C 1/003 36/136 |
| 2013/0312293 | A1 | 11/2013 | Gerber | |
| 2014/0000074 | A1 | 1/2014 | Guthner | |
| 2014/0068838 | A1 | 3/2014 | Beers et al. | |
| 2014/0070042 | A1 | 3/2014 | Beers et al. | |
| 2014/0082963 | A1 | 3/2014 | Beers | |
| 2015/0025937 | A1 | 1/2015 | Turner, Jr. | |
| 2015/0026937 | A1 * | 1/2015 | Nonogawa | A43C 1/02 24/713.6 |
| 2015/0289595 | A1 | 10/2015 | Rushbrook et al. | |
| 2017/0215524 | A1 | 8/2017 | Rushbrook et al. | |
| 2020/0046079 | A1 * | 2/2020 | Rushbrook | A43C 1/06 |

FOREIGN PATENT DOCUMENTS

| | | | |
|---|---|---|---|
| CN | 106231941 | A | 12/2016 |
| CN | 113558334 | | 10/2021 |
| DE | 29817003 | U1 | 3/1999 |
| DE | 19833801 | A1 | 2/2000 |
| DE | 10109673 | A1 | 9/2002 |
| DE | 102005036013 | A1 | 2/2007 |
| EP | 1064863 | A1 | 1/2001 |
| EP | 3131425 | | 3/2020 |
| FR | 2827486 | A1 | 1/2003 |
| GB | 2449722 | A | 12/2008 |
| JP | 2005036374 | A | 2/2005 |
| KR | 20120103222 | A | 9/2012 |
| WO | WO-0115559 | A1 | 3/2001 |
| WO | WO-0164066 | A2 | 9/2001 |
| WO | WO-2009071652 | A1 | 6/2009 |
| WO | WO-2009134858 | A1 | 11/2009 |
| WO | WO-2013136514 | A1 | 9/2013 |
| WO | WO-2014036371 | A1 | 3/2014 |
| WO | WO-2014036374 | A1 | 3/2014 |
| WO | WO-2015160790 | A1 | 10/2015 |

OTHER PUBLICATIONS

"European Application Serial No. 20163520.8, Response filed Feb. 15, 2022 to Communication Pursuant to Article 94(3) EPC dated Aug. 5, 2021", 28 pgs.

"U.S. Appl. No. 16/518,006, Notice of Allowance dated Aug. 26, 2021", 8 pgs.

"Chinese Application Serial No. 201580019826.5, Notice of Reexamination dated Jul. 9, 2020", W Concise Statement of Relevance, 9 pgs.

"European Application Serial No. 20163520.8, Extended European Search Report dated Jul. 24, 2020", 9 pgs.

"U.S. Appl. No. 16/518,006, Restriction Requirement dated Aug. 27, 2020", 8 pgs.

"U.S. Appl. No. 16/518,006, Response filed Oct. 14, 2020 to Restriction Requirement dated Aug. 27, 2020", 5 pgs.

U.S. Appl. No. 14/253,055 U.S. Pat. No. 9,629,418, filed Apr. 15, 2014, Footwear Having Motorized Adjustment System and Elastic Upper.

U.S. Appl. No. 15/488,158 U.S. Pat. No. 10,376,018, filed Apr. 14, 2017, Footwear Having Motorized Adjustment System and Elastic Upper.

U.S. Appl. No. 16/518,006, filed Jul. 22, 2019, Footwear Having Motorized Adjustment System and Elastic Upper.

"U.S. Appl. No. 16/518,006, Final Office Action dated May 6, 2021", 11 pgs.

"Chinese Application Serial No. 201580019826.5, Decision of Reexamination dated Apr. 9, 2021", w Concise Statement of Relevance, 21 pgs.

"European Application Serial No. 20163520.8, Response filed Apr. 12, 2021 to Extended European Search Report dated Jul. 24, 2020", 16 pgs.

"U.S. Appl. No. 16/518,006, Examiner Interview Summary dated Jun. 14, 2021", 2 pgs.

"U.S. Appl. No. 16/518,006, Response filed Jul. 6, 2021 to Final Office Action dated May 6, 2021", 7 pgs.

(56) References Cited

OTHER PUBLICATIONS

"U.S. Appl. No. 16/518,006, Advisory Action dated Jul. 16, 2021", 3 pgs.
"U.S. Appl. No. 16/518,006, Response filed Aug. 6, 2021 to Advisory Action dated Jul. 16, 2021", 7 pgs.
"European Application Serial No. 20163520.8, Communication Pursuant to Article 94(3) EPC dated Aug. 5, 2021", 4 pgs.
"U.S. Appl. No. 14/253,055, Advisory Action dated May 9, 2016", 3 pgs.
"U.S. Appl. No. 14/253,055, Examiner Interview Summary dated Oct. 16, 2015", 3 pgs.
"U.S. Appl. No. 14/253,055, Final Office Action dated Mar. 15, 2016", 21 pgs.
"U.S. Appl. No. 14/253,055, Final Office Action dated Sep. 8, 2016", 12 pgs.
"U.S. Appl. No. 14/253,055, Non Final Office Action dated Jul. 20, 2015", 14 pgs.
"U.S. Appl. No. 14/253,055, Non Final Office Action dated Jul. 21, 2016", 20 pgs.
"U.S. Appl. No. 14/253,055, Non Final Office Action dated Nov. 16, 2015", 17 pgs.
"U.S. Appl. No. 14/253,055, Notice of Allowance dated Dec. 16, 2016", 8 pgs.
"U.S. Appl. No. 14/253,055, Response filed Feb. 16, 2016 to Non Final Office Action dated Nov. 16, 2015", 16 pgs.
"U.S. Appl. No. 14/253,055, Response filed May 2, 2016 to Final Office Action dated Mar. 15, 2016", 12 pgs.
"U.S. Appl. No. 14/253,055, Response filed Aug. 1, 2016 to Non Final Office Action dated Jul. 21, 2016", 15 pgs.
"U.S. Appl. No. 14/253,055, Response filed Oct. 19, 2015 to Non Final Office Action dated Jul. 20, 2015", 19 pgs.
"U.S. Appl. No. 14/253,055, Response filed Nov. 30, 2016 to Final Office Action dated Sep. 8, 2016", 9 pgs.
"U.S. Appl. No. 15/488,158, Corrected Notice of Allowability dated Jun. 10, 2019", 2 pgs.
"U.S. Appl. No. 15/488,158, Examiner Interview Summary dated Feb. 14, 2019", 3 pgs.
"U.S. Appl. No. 15/488,158, Non Final Office Action dated Dec. 21, 2018", 24 pgs.
"U.S. Appl. No. 15/488,158, Notice of Allowability dated Jul. 2, 2019", 2 pgs.
"U.S. Appl. No. 15/488,158, Notice of Allowance dated Apr. 16, 2019", 9 pgs.
"U.S. Appl. No. 15/488,158, Response filed Mar. 21, 2019 to Non Final Office Action dated Dec. 21, 2018", 10 pgs.
"U.S. Appl. No. 16/518,006, Preliminary Amendment filed Nov. 5, 2019", 6 pgs.
"Chinese Application Serial No. 201580019826.5, Decision of Rejection dated Apr. 11, 2019", W/ English Translation, 9 pgs.
"Chinese Application Serial No. 201580019826.5, Office Action dated Jun. 7, 2018", w/English Summary, 10 pgs.
"Chinese Application Serial No. 201580019826.5, Office Action dated Sep. 5, 2017", w. English Claims, 13 pgs.
"Chinese Application Serial No. 201580019826.5, Request for Reexamination filed Jul. 26, 2019 to Decision of Rejection dated Apr. 11, 2019", w/ English claims, 11 pgs.
"Chinese Application Serial No. 201580019826.5, Response filed Jan. 9, 2018 to Office Action dated Sep. 5, 2017", w/ claims in English, 22 pgs.
"Chinese Application Serial No. 201580019826.5, Response filed Oct. 22, 2018 to Office Action mailed Jun. 7, 2018", w/ English claims, 21 pgs.
"European Application Serial No. 15719361.6, Communication Pursuant to Article 94(3) EPC dated Aug. 29, 2018", 7 pgs.
"European Application Serial No. 15719361.6, Office Action dated Mar. 28, 2019", too official response will be filed, instead, amendments will be incorporated into the drux exemplar of the 71(3) communication, 1 pg.
"European Application Serial No. 15719361.6, Response filed Feb. 27, 2019 to Communication Pursuant to Article 94(3) EPC dated Aug. 29, 2018", 14 pgs.
"European Application Serial No. 15719361.6, Response filed May 19, 2017 to Communication Pursuant to Rules 161(2) and 162 EPC dated Nov. 12, 2016", 28 pgs.
"International Application Serial No. PCT/US2013/057462, International Preliminary Report on Patentability dated Mar. 12, 2015", 9 pgs.
"International Application Serial No. PCT/US2013/057462, International Search Report dated Jan. 3, 2014", 5 pgs.
"International Application Serial No. PCT/US2013/057462, Written Opinion dated Jan. 3, 2014", 7 pgs.
"International Application Serial No. PCT/US2013/057467, International Preliminary Report on Patentability dated Mar. 12, 2015", 9 pgs.
"International Application Serial No. PCT/US2013/057467, International Search Report dated Jan. 3, 2014", 5 pgs.
"International Application Serial No. PCT/US2013/057467, Written Opinion dated Jan. 3, 2014", 7 pgs.
"International Application Serial No. PCT/US2014/056207, International Search Report dated Dec. 22, 2014", 3 pgs.
"International Application Serial No. PCT/US2014/056207, Written Opinion dated Dec. 22, 2014", 7 pgs.
"International Application Serial No. PCT/US2015/025725, International Preliminary Report on Patentability dated Oct. 27, 2016", 9 pgs.
"International Application Serial No. PCT/US2015/025725, International Search Report dated Jul. 20, 2015", 3 pgs.
"International Application Serial No. PCT/US2015/025725, Written Opinion dated Jul. 20, 2015", 7 pgs.
Blake, Bevin, "About the Project", Power-Laces.com Archived, [Online], Retrieved from the Internet: <URL: http://web.archive.org/web/20120818223427/http://www.power-laces.com>, (Aug. 18, 2012), 2 pgs.
Blake, Bevin, "Power Laces Prototype Version 1", [Online] retrieved from the internet: <http://www.youtube.com/watch?v=ROEZsOHpFQc&feature=endscreen&NR=1>, (Uploaded Jul. 4, 2010), 3 pgs.
Blake, Bevin, "Power Laces Prototype Version 2", [Online] retrieved from the internet: <http://www.youtube.com/watch7v=k Efr2TaEPo>, (Aug. 29, 2010), 7 pgs.
"Chinese Application Serial No. 201580019826.5, Response filed Oct. 26, 2020 to Notice of Reexamination dated Jul. 9, 2020", w current English claims, claims not amended in response filed, 7 pgs.
"U.S. Appl. No. 16/518,006, Non Final Office Action dated Jan. 12, 2021", 13 pgs.
"U.S. Appl. No. 16/518,006, Examiner Interview Summary dated Feb. 24, 2021", 2 pgs.
"U.S. Appl. No. 16/518,006, Response filed Apr. 12, 2021 to Non Final Office Action dated Jan. 12, 2021", 7 pgs.
"Chinese Application Serial No. 201580019826.5, Response filed Mar. 25, 2021 to Notice of Reexamination dated Feb. 10, 2021", w current English claims, claims not amended in response filed, 12 pgs.
"U.S. Appl. No. 17/571,798, Preliminary Amendment filed May 23, 2022", 6 pgs.
"Chinese Application Serial No. 202110777077.X, Office Action dated May 23, 2022", W/English Translation, 19 pgs.
"European Application Serial No. 20163520.8, Communication Pursuant to Article 94(3) EPG dated May 20, 2022", 5 pgs.
U.S. Appl. No. 17/571,798, filed Jan. 10, 2022, Footware Having Motorized Adjustment System and Elastic Upper.

* cited by examiner

FOOTWEAR HAVING MOTORIZED ADJUSTMENT SYSTEM AND ELASTIC UPPER

CROSS-REFERENCE TO RELATED APPLICATION

This application is a continuation of U.S. application Ser. No. 14/253,055, filed Apr. 15, 2014, issued Apr. 25, 2017 as U.S. Pat. No. 9,629,418 which is incorporated by reference herein in its entirety.

BACKGROUND

The present embodiments relate generally to articles of footwear and including motorized adjustment systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

In some cases, the lacing system may include a motorized tensioning system. Components of a motorized tensioning system may include, for example, a motorized tightening device, a control unit, and a battery. Each of these components may be incorporated into an article of footwear in various places. In some cases, one or more of these components may be concealed, for example within the sole structure. In some cases, however, space may be limited in the sole structure. Further, it may be desirable to replace one or more of these components during the life of the footwear.

In some cases, relatively inelastic materials may be utilized to provide support, stability, responsiveness, durability, and other performance characteristics. In addition, elastic materials may be utilized in the upper to provide fit and comfort. Further, by using elastic materials, the upper may omit an opening in the lacing region, relying instead on the elasticity of the upper to allow the wearer to insert their foot into the footwear. Using elastic materials in such a way may enable the upper to be relatively streamlined, in some cases sock-like. In order to further provide the upper with a streamlined configuration, it may be desirable to provide a lacing system that adjusts the fit of the footwear, while maintaining a low profile.

SUMMARY

In some embodiments, the disclosed footwear may be configured with the control unit and power source concealed in the sole structure and the tightening device mounted on an external portion of the upper. Further, the control unit and/or the power source may be configured to be mounted within a removable portion of the sole structure, such a midsole. Accordingly, the control unit and/or the power source may be removable and replaceable.

In some embodiments, the disclosed footwear may utilize a motorized tensioning system configured to draw portions of the upper toward one another to adjust the fit of the footwear. The upper may be formed of both elastic and relatively inelastic materials. The tensioning system may include a tensile member (serving as the lace) threaded through lace receiving members fixed to relatively inelastic portions of the upper. In some embodiments, streamlining of the upper may be further provided by fusing the elastic material and the relatively inelastic material together to form a continuous upper.

In one aspect, the present disclosure is directed to an article of footwear. The article of footwear may include an upper configured to receive a foot of a wearer and a sole structure fixedly attached to the upper, the sole structure including a ground-contacting outer member and a removable midsole. The footwear may further include a motorized tensioning system including a power source, a control unit, a tensile member, and a motorized tightening device, the motorized tightening device being attached to an outer surface of the upper, and the tightening device being configured to apply tension in the tensile member to adjust the size of an internal void defined by the article of footwear. In addition, the power source and the control unit of the tensioning system may be configured to be removably disposed in the removable midsole.

In another aspect, the present disclosure is directed to an article of footwear, including an upper configured to receive a foot of a wearer and a sole structure fixedly attached to the upper. The footwear may include a motorized tensioning system including a tensile member and a motorized tightening device, the motorized tightening device being configured to apply tension in the tensile member to adjust the size of an internal void defined by the article of footwear. In addition, the footwear may include a tightening device housing in which the tightening device is disposed, the tightening device housing being fixedly attached to the upper of the article of footwear and the tightening device being removably attached to the upper.

In another aspect, the present disclosure is directed to a method of making an article of footwear. The method may include forming an upper configured to receive a foot of a wearer and fixedly attaching a sole structure to the upper. In addition, the method may include threading a tensile member through a plurality of lace receiving members. Also, the method may include removably attaching a tightening device to an outer surface of the upper, the tightening device being configured to apply tension in the tensile member to adjust the size of an internal void defined by the article of footwear. Further, the method may include removably disposing a power source in a removable midsole, the power source being configured to power the tightening device and removably inserting the removable midsole through an opening configured to receive a foot of a wearer.

In another aspect, the present disclosure is directed to an article of footwear, including an upper configured to receive a foot of a wearer, the upper including one or more elastic portions and one or more substantially inelastic portions. The footwear may further include a plurality of lace receiving members fixedly attached to an outer surface of the upper on the inelastic portions of the upper. Also, the footwear may include a sole structure fixedly attached to the upper. In addition, the footwear may include a motorized tensioning system including a motorized tightening device and a tensile member extending through the plurality of lace receiving members, the tightening device being configured to apply tension in the tensile member to adjust the size of an internal void defined by the article of footwear by drawing two or more of the plurality of lace receiving members closer to one another.

In another aspect, the present disclosure is directed to an article of footwear, including a sole structure and an upper configured to receive a foot of a wearer and fixedly attached to the sole structure, the upper including a first substantially inelastic portion, a second substantially inelastic portion, and an elastic portion extending between the first substantially inelastic portion and the second substantially inelastic portion, the elastic portion being fused to the first substantially inelastic portion and the second substantially inelastic portion. The footwear may also include a first lace receiving member fixedly attached to the first substantially inelastic portion. Also, the footwear may include a second lace receiving member fixedly attached to the second substantially inelastic portion. In addition, the footwear may include a motorized tensioning system including a motorized tightening device and a tensile member extending through the first lace receiving member and the second lace receiving member, the tightening device being configured to apply tension in the tensile member to adjust the size of an internal void defined by the article of footwear by drawing the first substantially inelastic portion of the upper toward the second substantially inelastic portion of the upper.

In another aspect, the present disclosure is directed to a method of adjusting an article of footwear. The method may include activating a motorized tightening device to apply tension in a tensile member to adjust the size of an internal void defined by the article of footwear by drawing a first substantially inelastic portion of the upper toward a second substantially inelastic portion of the upper, thereby allowing an elastic portion of the upper fused to, and extending between, the first substantially inelastic portion and the second substantially inelastic portion to return from a first stretched condition to second, less stretched condition.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The drawings are schematic and, accordingly, the components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
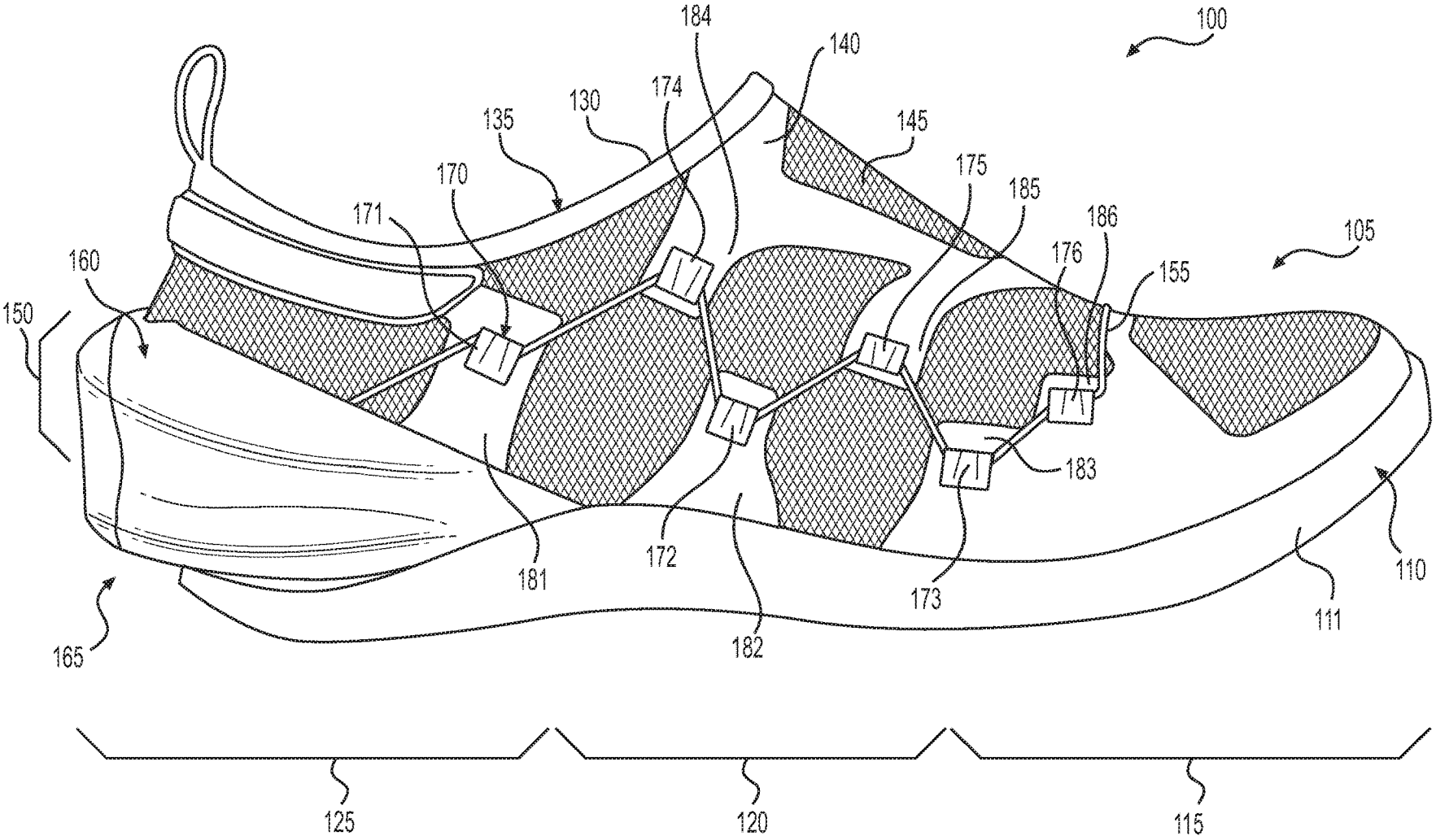
FIG. 1 is a schematic illustration of a side view of an article of footwear including a motorized tensioning system.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends from a forefoot region to a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" shall refer to the joining of two components in a manner such that the two components are secured together, but may be readily detached from one another. Examples of removable attachment mechanisms may include hook and loop fasteners, friction fit connections, interference fit connections, threaded connectors, cam-locking connectors, and other such readily detachable connectors. Similarly, "removably disposed" shall refer to the assembly of two components in a non-permanent fashion.

An article of footwear may include a motorized tensioning system configured to adjust the fit of the footwear. The motorized tensioning system enables relatively rapid tightening of the footwear. In addition, in some embodiments the tightening system may provide incremental tightening. Such incremental tightening may enable the user to achieve a predictable tightness for each wearing. In some embodiments, sensors may be included to monitor tightness. In such embodiments, the user may also achieve a predictable tightness.

In some cases, using a motorized tightening device may remove dexterity issues that may occur with other tensioning technologies (pulling straps, Velcro, and other such manual closure systems). Such a design could improve the use of footwear for physically impaired or injured individuals who may otherwise have a hard time putting on and adjusting their footwear. Using the designs proposed here, footwear could be tightened via a push button or remote interface.

In some embodiments, the tensioning system may be remotely controlled, for example by a bracelet or hand-held device, such as a mobile phone. In such embodiments, adjustments may be made without the wearer having to stop the activity in which they are participating. For example, a distance runner may adjust the tightness of their footwear without interrupting their workout or competitive event to bend over and adjust their footwear manually or by pressing buttons on the footwear to activate the motorized tensioning system.

In addition, the tensioning system may also be configured to make automatic adjustments. For example, using tightness sensors, the system may be configured to maintain tightness during wear by adjusting tightness according to changes in the fit. For example, as feet swell during wear, the tensioning system may release tension on the tensile member, in order to maintain the initially selected tightness.

Further, the tensioning system may be configured to adjust the tightness during use to improve performance. For example, as a wearer places loads on the footwear during an athletic activity, the system may tighten or loosen the tensile members to achieve desired performance characteristics. For example, as a runner proceeds around a curve, the tensioning system may tighten the footwear in order to provide additional stability and maintain the foot in a centralized position within the footwear. As another example, when a runner is running downhill, the tightening system may loosen the footwear to limit additional forces exerted on the foot as the foot tends to slide toward the front of the footwear during the downhill run. Numerous other automated adjustments may be utilized for performance. Such automated adjustments may vary for each activity. In addition, the type and amount of such adjustments may be preselected by the user. For instance, using the examples above, the user may select whether to tighten or loosen the footwear while proceeding around a curve. In addition, the user may select whether to utilize an automated adjustment at all during certain conditions. For example, the user may choose to implement the adjustment while proceeding around curves, but may opt not to utilize an adjustment when running downhill.

FIG. 1 is a schematic illustration of a side view of an article of footwear 100 including a motorized tensioning system 150. Footwear 100 may be any of a variety of footwear types, including athletic footwear, such as running shoes, basketball shoes, soccer shoes, cross-training shoes, baseball shoes, football shoes, and golf shoes, for example. In other embodiments, footwear 100 may be another type of footwear including, but not limited to, hiking boots, casual footwear, such as dress shoes, as well as any other kinds of footwear. Accordingly, the disclosed concepts may be applicable to a wide variety of footwear types.

As shown in FIG. 1, footwear 100 may include an upper 105 and a sole structure 110 secured to upper 105. Sole structure 110 may be fixedly attached to upper 105 (for example, with adhesive, stitching, welding, or other suitable techniques) and may have a configuration that extends between upper 105 and the ground. Sole structure 110 may include provisions for attenuating ground reaction forces (that is, cushioning and stabilizing the foot during vertical and horizontal loading). In addition, sole structure 110 may be configured to provide traction, impart stability, and control or limit various foot motions, such as pronation, supination, or other motions.

The configuration of sole structure 110 may vary significantly according to one or more types of ground surfaces on which sole structure 110 may be used. For example, the disclosed concepts may be applicable to footwear configured for use on any of a variety of surfaces, including indoor surfaces or outdoor surfaces. The configuration of sole structure 110 may vary based on the properties and conditions of the surfaces on which footwear 100 is anticipated to be used. For example, sole structure 110 may vary depending on whether the surface is harder or softer. In addition, sole structure 110 may be tailored for use in wet or dry conditions.

Upper 105 may include one or more material elements (for example, meshes, textiles, foam, leather, and synthetic leather), which may be joined to define an interior void 135 configured to receive a foot of a wearer. Upper 105 may define a throat opening 130 through which a foot of a wearer may be received into void 135.

As shown in FIG. 1 for reference purposes, footwear 100 may be divided into three general regions, including a forefoot region 115, a midfoot region 120, and a heel region 125. Forefoot region 115 generally includes portions of footwear 100 corresponding with the toes and the joints connecting the metatarsals with the phalanges. Midfoot region 120 generally includes portions of footwear 100 corresponding with an arch area of the foot. Heel region 125 generally corresponds with rear portions of the foot, including the calcaneus bone. Forefoot region 115, midfoot region 120, and heel region 125 are not intended to demarcate precise areas of footwear 100. Rather, forefoot region 115, midfoot region 120, and heel region 125 are intended to represent general relative areas of footwear 100 to aid in the following discussion.

The material elements of upper 105 may be selected and arranged to selectively impart properties such as light weight, durability, stability, support, air-permeability, wear-resistance, flexibility, fit, and comfort. In some embodiments, upper 105 may include both elastic portions and substantially inelastic portions. Exemplary elastic materials suitable for use in the disclosed embodiments may include latex, Spandex or elastase (which is often sold under the trademark LYCRA®), elastic mesh materials, and/or any other suitable elastic materials.

The elastic material used in the upper may provide improved fit and comfort by providing the upper with flexibility and stretch to enable the upper to conform to the foot of the wearer. Incorporation of the elastic material enables a close-fitting article of footwear to remain comfortable. In some athletic activities, such as soccer, a particularly close-fitting upper is desirable for reasons of performance. For example, while some athletic shoes are desired to fit with a small amount of space (for example ⅜ to ½ inch) between the wearer's toes and the inside front of the cavity within the upper, soccer shoes are desired to fit with no space or virtually no space between the toes and the inside front of the upper. Any extra length of a soccer shoe will tend to catch on the ground when attempting to kick a soccer ball. In addition, a soccer shoe is desired to fit closely around the top and sides of the shoe, to prevent the foot from sliding around inside the shoe, and thereby provide a predictable outer surface which will contact the ball. Further, a relatively thin upper material is also desirable for a soccer shoe in order to provide feel of the ball as well as reduced weight. Close fitting footwear is also desirable for other athletic activities. Close fit, generally, may provide increased stability and responsiveness. Thus, in order to provide a close-fitting, thin upper, that is comfortable and high performing, an elastic material may be used in the upper.

In some embodiments, the upper may include one or more reinforcing structures, which may provide strength, stability, durability, and other performance benefits. For example, in some embodiments, the upper may include substantially inelastic reinforcing material selectively located adjacent portions of the elastic material. Exemplary inelastic materials that may be used with the disclosed embodiments may include, for example, Lorica, K-lite, textiles, thermoplastic, leather, synthetic leather, vinyl, and/or any other suitable inelastic material. The inelastic (or substantially inelastic) material may have any suitable level of elasticity, which may be relatively low. It will be understood that the term "elastic material," as used in this specification and claims, shall refer to material that is more elastic than the substantially inelastic material. To illustrate an exemplary comparison between elastic and substantially inelastic materials suitable for use in the disclosed embodiments, an exemplary footwear upper according to the disclosed embodiments may include an elastic material such as LYCRA® and a relatively inelastic material (as compared to LYCRA®) such as leather or synthetic leather.

In some embodiments, the substantially inelastic material may be layered with, but not attached to, the elastic material. In other embodiments, the reinforcing material may be attached, at least partially, to other components of the footwear. In some embodiments, the substantially inelastic material may be attached to the elastic material, for example, by stitching, adhesive, bonding, welding/fusing, or any other suitable attachment method. In some embodiments, the substantially inelastic material may be attached in only select areas to the elastic material. For example, a strip of substantially inelastic material may be attached to the elastic material only at the ends of the strip, leaving the middle portion of the strip overlapping but disconnected from the elastic material. This may provide the upper with greater flexibility to conform to the shape of the foot, while maintaining the strength benefits of the substantially inelastic material. In some embodiments, the elastic material may extend between the substantially inelastic material portions, with minimal overlapping. This may minimize weight.

The substantially inelastic material may be selectively located in any suitable portion of the upper to provide reinforcement, stability, and durability as desired. In addition to the placement of the substantially inelastic material, the amount of substantially inelastic material may be selected according to predetermined performance criteria. For example, more inelastic material may be utilized to provide more strength and support, while less inelastic material may be utilized to provide flexibility, stretchability, and reduced weight.

In some embodiments, the substantially inelastic material may be attached to the elastic material by fusing or welding. As utilized herein, the terms "fusing" and "welding" (and variants thereof) are defined as a securing technique between two elements that involves a softening or melting of the material of at least one of the elements such that the materials of the elements are secured to each other when cooled. Similarly, the term "weld" or variants thereof is defined as the bond, link, or structure that joins two elements through a process that involves a softening or melting of material within at least one of the elements such that the elements are secured to each other when cooled. In some embodiments, welding may involve the melting or softening of two components such that the materials from each component intermingle with each other, that is, the materials may diffuse across a boundary layer (or "heat affected zone") between the materials, and are secured together when cooled. In some embodiments, welding may involve the melting or softening of a material in a first component such that the material extends into or infiltrates the structure of a second component, for example, infiltrating crevices or cavities in the second component or extending around or bonding with filaments or fibers in the second component to secure the components together when cooled. Thus, welding of two components together may occur when material from one or both of the components melts or softens. Accordingly, a weldable material, such as a polymer material, may be provided in one or both of the components. Additionally, welding does not generally involve the use of stitching or adhesives, but involves directly bonding components to each other with heat. In some situations, however, stitching or adhesives may be utilized to supplement the weld or the joining of the components through welding. Components that have been welded together will be understood to be "fused" together.

A variety of heating techniques may be utilized to weld components to each other. In some embodiments, suitable heating techniques may include conduction heating, radiant heating, high frequency heating, laser heating, or combinations of such techniques. In some embodiments, the welding method used to join portions of the upper may include a high frequency welding method, such as ultrasonic welding or radio frequency (RF) welding.

In embodiments where a high frequency welding method is used to form welds in the upper, the materials of the upper may be any materials suitable for such a method. For example, materials suitable for high frequency welding may include thermoplastic material or natural material coated with a thermoplastic material. Examples of material suitable for high frequency welding methods include an acrylic, a nylon, a polyester, a polylactic acid, a polyethylene, a polypropylene, polyvinyl chloride (PVC), a urethane, a natural fiber that is coated with one or more thermoplastic materials, and combinations of such materials. In some embodiments, a natural fiber, such as cotton or wool, may be coated with a thermoplastic material, such as an ethyl vinyl acetate or thermoplastic polyurethane.

Use of welding can provide various advantages over use of adhesives or stitching. For example, use of welding may produce a lighter weight shoe due to the absence of stitching and adhesives. By eliminating stitching and adhesives, the mass that would otherwise be imparted by stitching and adhesives may be utilized for other structural elements that enhance the performance properties of the article of footwear, such as cushioning, durability, stability, and aesthetic qualities. Another advantage relates to manufacturing efficiency and expense. Stitching and application of adhesives can be relatively time-consuming processes. By welding components, manufacturing time may be reduced. Further, costs may be reduced by eliminating the expense of adhesives or stitching materials. In addition, since adhesives and stitching can increase the rigidity of upper materials, welding (that is, joining materials without using adhesives or stitching) can preserve the flexibility of the upper of the article of footwear. Flexibility of the upper can enable the upper to conform to the foot of a wearer, thus providing improved fit. By conforming to the foot of the wearer, a flexible upper may also provide improved comfort.

In some embodiments, the elastic portions may be an elastic mesh. In portions of the upper, the elastic mesh may remain unreinforced, permitting directed ventilation through the upper. That is, in unreinforced portions, the elastic mesh may have an outwardly exposed outer surface and an inwardly exposed inner surface. Accordingly, in such embodiments, the openings in the mesh of the unreinforced elastic mesh may permit ventilation through the upper. In addition to ventilation, the openings in the elastic mesh may also provide other advantages, such as weight reduction, flexibility, and other advantages. In some embodiments, in the unreinforced portions of the elastic material, the upper may consist essentially of the elastic material layer, and thus, may not include any additional layers.

Upper 105 may be formed of a plurality of elastic portions 145 and a plurality of substantially inelastic portions 140. As shown in FIG. 1, substantially inelastic portions 140 may include a first substantially inelastic portion 181, a second substantially inelastic portion 182, a third substantially inelastic portion 183, a fourth substantially inelastic portion 184, a fifth substantially inelastic portion 185, and a sixth substantially inelastic portion 186. Substantially inelastic portions 140 may form a skeletal structure, providing reinforcement to upper 105. As shown in FIG. 1, substantially inelastic portions 140 may form an exoskeleton.

It will be noted that elastic portions 145 are illustrated, in the accompanying drawings, as a relatively simple grid representation. This grid representation is schematic only, and is provided in this manner for convenience and to avoid obscuring the drawings with excessive detail. Examples of suitable elastic materials are provided above. In some embodiments, the elastic material may be a mesh. However, the grid shown in the drawings is schematic only, and thus, is not necessarily reflective of the actual mesh structure.

In embodiments utilizing a mesh elastic material, the orientation of the mesh grid may vary. Further, in some embodiments, other more complicated grid structures may be utilized for the mesh material. In addition, the size of the grid openings may also vary. The configuration of a suitable elastic mesh material may be selected according to desired performance characteristics, including weight, strength, puncture resistance, ventilation, and other attributes.

As shown in FIG. 1 footwear 100 may include a plurality of lace receiving members 170. Lace receiving members 170 may be configured to receive a lace or tensile member 155 for adjusting the fit of footwear 100. As shown in FIG. 1, lace receiving members 170 may be fixedly attached to substantially inelastic portions 140 of upper 105. For example, a first lace receiving member 171 may be fixedly attached to first substantially inelastic portion 181. A second lace receiving member 172 may be fixedly attached to second substantially inelastic portion 182. A third lace receiving member 173 may be fixedly attached to third substantially inelastic portion 183. A fourth lace receiving member 174 may be fixedly attached to fourth substantially inelastic portion 184. A fifth lace receiving member 175 may be fixedly attached to fifth substantially inelastic portion 185. And a sixth lace receiving member 176 may be fixedly attached to sixth substantially inelastic portion 186.

It will be noted that, in some embodiments, the arrangement of substantially inelastic portions and corresponding lace receiving members illustrated in FIG. 1 may be provided on both the medial side and the lateral side of footwear 110. That is, in some embodiments, tensile member 155 may extend across the instep region in forefoot region 115 to the opposite side of footwear 100, as shown in FIG. 1. Accordingly, tension may be applied to tensile member 155 from both sides of footwear 100. In some embodiments, the lacing arrangements of tensile member 155 on the medial and lateral sides of footwear 100 may be substantial mirror images.

The arrangement of lace receiving members 170 in this embodiment is only intended to be exemplary and it will be understood that other embodiments are not limited to a particular configuration for lace receiving members 170. Furthermore, the particular types of lace receiving members 170 illustrated in the embodiments are also exemplary and other embodiments may incorporate any other kinds of lace receiving members or similar lacing provisions. In some other embodiments, for example, footwear 100 may include traditional eyelets. Some examples of lace guiding provisions that may be incorporated into the embodiments are disclosed in Cotterman et al., U.S. Patent Application Publication Number 2012/0000091, published Jan. 5, 2012 and entitled "Lace Guide," the disclosure of which is incorporated herein by reference in its entirety. Additional examples are disclosed in Goodman et al., U.S. Patent Application Publication Number 2011/0266384, published Nov. 3, 2011 and entitled "Reel Based Lacing System" (the "Reel Based Lacing Application"), the disclosure of which is incorporated herein by reference in its entirety. Still additional examples of lace receiving members are disclosed in Kerns et al., U.S. Patent Application Publication Number 2011/0225843, published Sep. 22, 2011 and entitled "Guides For Lacing Systems," the disclosure of which is incorporated herein by reference in its entirety.

Tensioning system 150 may comprise various components and systems for adjusting the size of opening 130 and thereby tightening (or loosening) upper 105 around a wearer's foot. In some embodiments, tensioning system 150 may comprise tensile member 155 and a motorized tightening device 160 configured to apply tension in tensile member 155, (See also, FIGS. 5 and 6.) In some embodiments, tightening device 160 may be attached to an outer surface of footwear 100. For example, in some embodiments, tightening device 160 may be attached to an outer surface of upper 105. In some embodiments, tightening device may be enclosed within a tightening device housing 165, as shown in FIG. 1.

Tightening device 160 may be configured to apply tension in tensile member 155 to adjust the size of internal void 135 defined by footwear 100. In some embodiments, tightening device 160 may include provisions for winding and unwinding portions of tensile member 155. Tightening device may include a motor. In some embodiments, the motor may be an electric motor. However, in other embodiments, the motor could comprise any kind of non-electric motor known in the art. Examples of different motors that can be used include, but are not limited to: DC motors (such as permanent-magnet motors, brushed DC motors, brushless DC motors, switched reluctance motors, etc.), AC motors (such as motors with sliding rotors, synchronous electrical motors, asynchronous electrical motors, induction motors, etc.), universal motors, stepper motors, piezoelectric motors, as well as any other kinds of motors known in the art.

Tensile member 155 may be configured to pass through various different lace receiving members 170 in the lacing region. In some cases, lace receiving members 170 may provide a similar function to traditional eyelets on uppers. In particular, as tensile member 155 is pulled or tensioned, throat opening 130 may generally constrict so that upper 105 is tightened around a foot.

Tensile member 155 may comprise any type of type of lacing material known in the art. Examples of lace that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township N.J., although other kinds of extended chain, high modulus polyethylene fiber materials can also be used as a lace. Still further exemplary properties of a lace can be found in the Reel Based Lacing Application mentioned above. The term "tensile member," as used throughout this detailed description and in the claims, refers to any component that has a generally elongated shape and high tensile strength. In some cases, a tensile member could also have a generally low elasticity. Examples of different tensile members include, but are not limited to: laces, cables, straps and cords. In some cases, tensile members may be used to fasten and/or tighten an article footwear. In some embodiments, tensile member 155 may be removable. Accordingly, in some case, tensile member 155 may be replaced by, a manual (i.e., traditional) shoelace.

Figure 2:
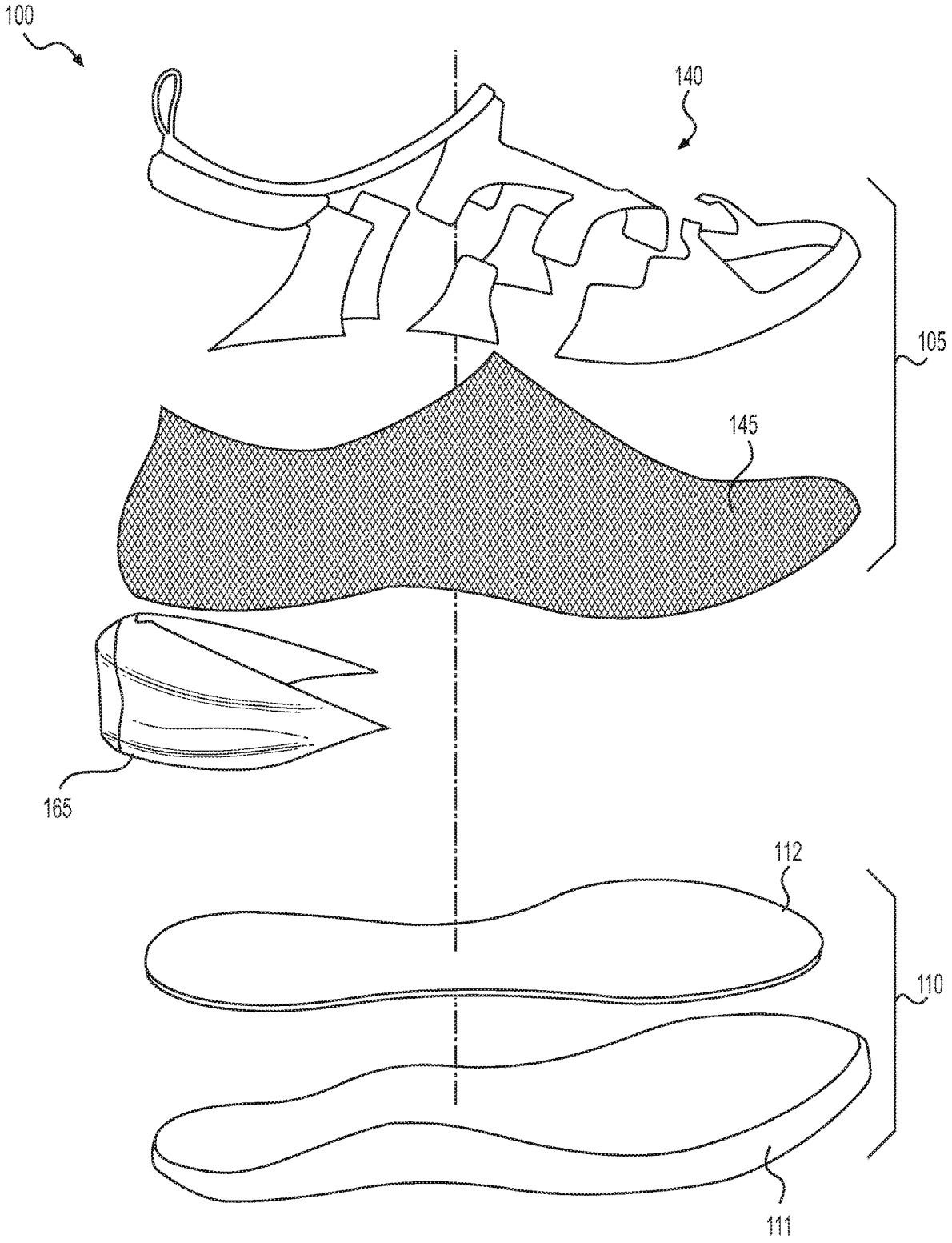
FIG. 2 is a schematic illustration of an exploded, side view of the article of footwear shown in FIG. 1.

FIG. 2 is a schematic illustration of an exploded, side view of footwear 100. As shown in FIG. 2, in some embodiments, sole structure 110 may include multiple components, which may individually or collectively provide footwear 100 with a number of attributes, such as support, rigidity, flexibility, stability, cushioning, comfort, reduced weight, or other attributes. In some embodiments, sole structure 110 may include a ground-contacting outer sole member 111 and a midsole 112, as shown in FIG. 2. In addition, in some embodiments, sole structure 110 may include an insole/sockliner (not shown). In some cases, however, one or more of these components may be omitted.

The insole may be disposed in the void defined by upper 105. The insole may extend a full length of footwear 100. The insole may be formed of a deformable (for example, compressible) material, such as polyurethane foams, or other polymer foam materials. Accordingly, the insole may, by virtue of its compressibility, provide cushioning, and may also conform to the foot in order to provide comfort, support, and stability.

Midsole 112 may extend a full length of footwear 100. Midsole 112 may be formed from any suitable material having the properties described above, according to the activity for which footwear 100 is intended. In some embodiments, midsole 112 may include a foamed polymer material, such as polyurethane (PU), ethyl vinyl acetate (EVA), or any other suitable material that operates to attenuate ground reaction forces as sole structure 110 contacts the ground during walking, running, or other ambulatory activities.

As further shown in FIG. 2, upper 105 may include substantially inelastic portions 140. Extending between substantially inelastic portions 140 is are elastic portions 145, which, as shown in FIG. 2, may be formed of a full length piece of elastic material. As discussed above, the elastic material may be fused with the substantially inelastic material. In other embodiments, elastic material may be selectively placed in between the substantially inelastic portions. (See FIG. 19.)

FIG. 2 also shows tightening device housing 165. In some embodiments, tightening device housing 165 may be fixedly attached to upper 105. In addition to protecting and concealing the tightening device, tightening device housing 165 may provide structural support to the heel region of upper 105 and to footwear 100 in general. In some embodiments, upper 105 may include a substantially rigid structure, such as a heel counter, to which tightening device 160 and tightening device 165 may be attached. Such structure has been omitted from FIG. 2 for purposes of clarity in illustrating the exploded view of footwear 100. Other layers that may be included in footwear 100 that have been omitted from FIG. 2 for the sake of clarity may include liners and padding for upper 105.

Figure 3:
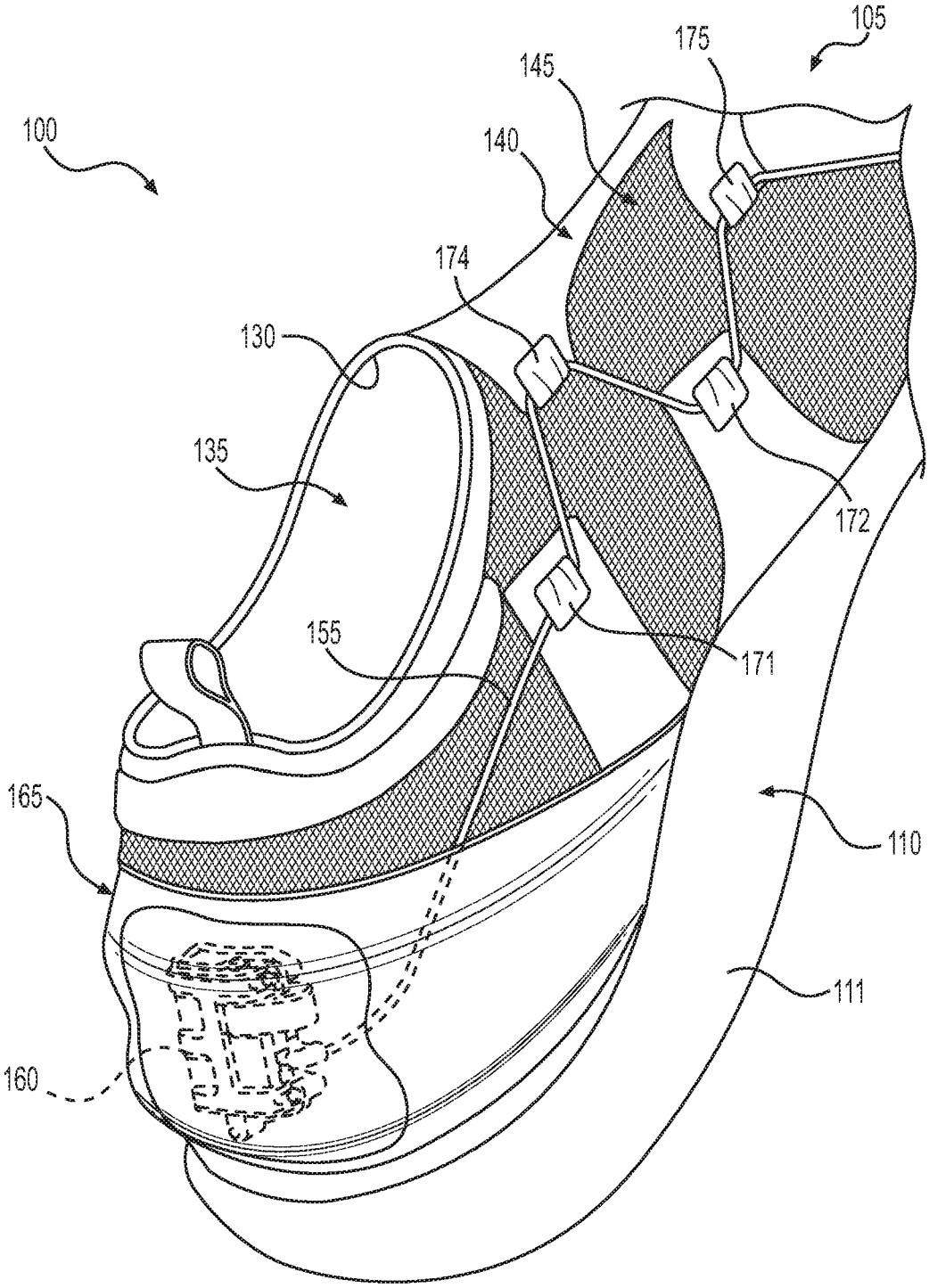
FIG. 3 is a schematic illustration of a rear perspective view of the article of footwear shown in FIG. 1.

FIG. 3 is a schematic illustration of a rear perspective view of footwear 100. As shown in FIG. 3, tightening device 160 may be disposed within tightening device housing 165. In some embodiments, tightening device housing 165 may be fixedly attached to upper 105. In addition, tightening device 160 may be removably attached to upper 105 within tightening device housing 165. As shown in FIG. 3, in some embodiments, tightening device 160 may be attached to a heel portion of upper 105 of footwear 100. For example, in some embodiments, tightening device 160 may be removably attached to a rearmost portion of the heel of upper 105. This positioning may facilitate the application of tension to tensile members on both a medial side and a lateral side of footwear 100.

The location of the motorized tightening device can vary from one embodiment to another. The illustrated embodiments show a motorized tightening device disposed on the heel of an upper. However, other embodiments may incorporate a motorized tightening device in any other location of an article of footwear, including the forefoot and midfoot portions of an upper. In still other embodiments, a motorized tightening device could be disposed in a sole structure of an article. The location of a motorized tightening device may be selected according to various factors including, but not limited to: size constraints, manufacturing constraints, aesthetic preferences, optimal lacing placement, ease of removability as well as possibly other factors.

In some embodiments, tightening device housing 165 may have a substantially smooth contoured configuration. For example, as shown in FIG. 3, tightening device housing 165 may have a smooth, tapered transition to the outer surface of upper 105. This smooth, contoured configuration, as well as the location of housing 165 on the rearmost heel portion of footwear 100 may minimize unwanted catching of tightening device housing 165 on obstacles.

In some embodiments, the midsole may be removable. In such embodiments, one or more components of the tensioning system may be incorporated into the midsole. For example, in some embodiments, a control unit and a power source may be removably disposed in the removable midsole. Accordingly, the power source and control unit may be removed from the article of footwear for repair or replacement. By disposing the control unit and power source in the midsole, these components may be concealed from view, and may be mounted in the article of footwear without protruding from the upper.

Figure 4:
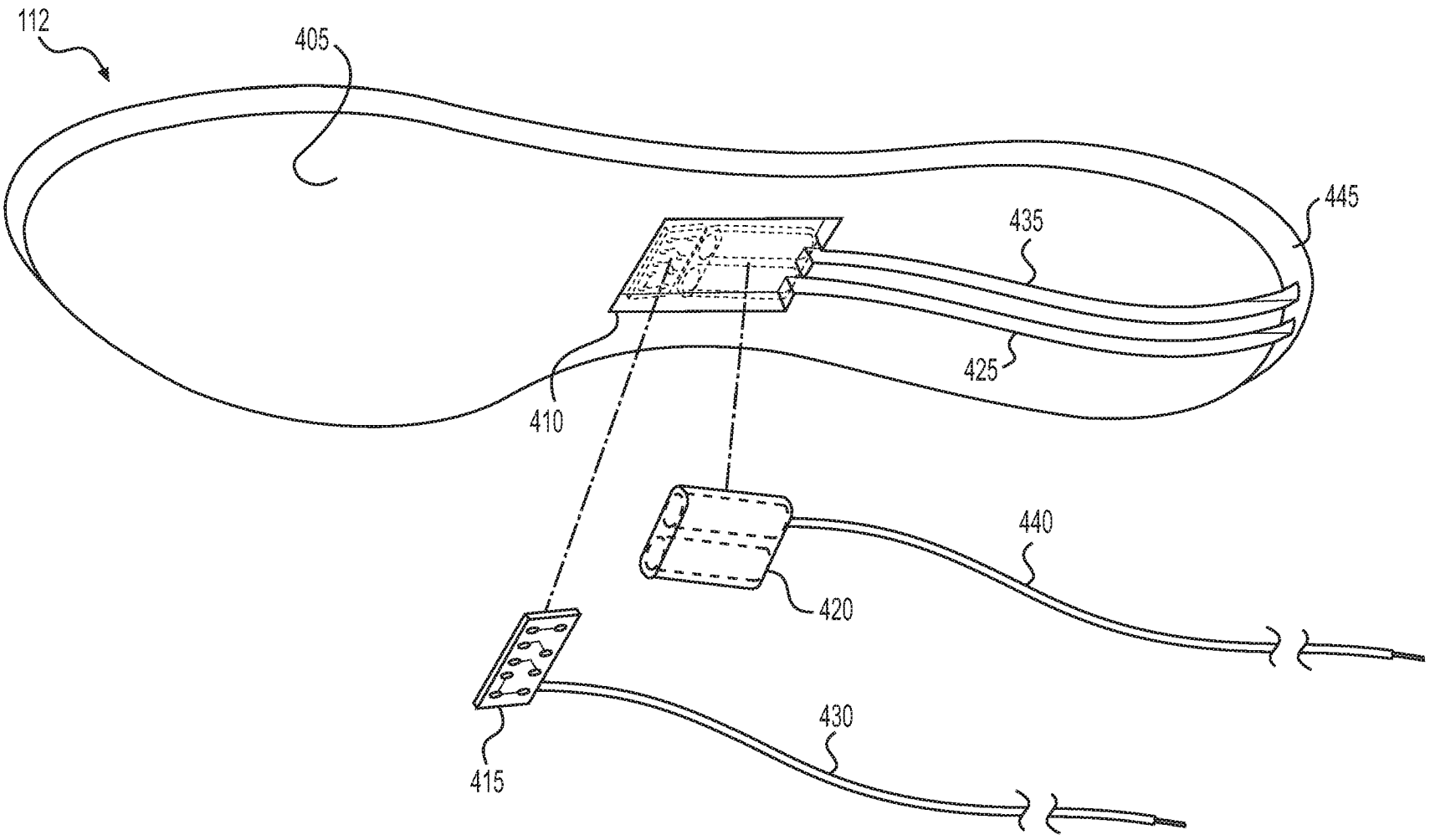
FIG. 4 is a schematic illustration of an exploded, bottom, perspective view of a removable midsole, a power source, and a control unit.

FIG. 4 is a schematic illustration of an exploded, bottom, perspective view of midsole 112, as well as a control unit 415 and a power source 420 for the tensioning system. Control unit 415 may be configured to control the operation of tightening device 160. In some embodiments, control unit 415 may be attached to the outer surface of footwear, such as outer surface 111 of upper 105. Control unit 415 may include various circuitry components. In addition, control unit 415 may include a processor, configured to control motorized tightening device 160.

Control unit 415 shown in the accompanying figures is only intended as a schematic representation of one or more control technologies that could be used with tightening device 160. For example, there are various approaches to motor control that may be employed to allow speed and direction control. For some embodiments, a microcontroller unit may be used. The microcontroller may use internal interrupt generated timing pulses to create pulse-width modulation (PWM) output. This PWM output is fed to an H-bridge which allows high current PWM pulses to drive the motor both clockwise and counterclockwise with speed control. However, any other methods of motor control known in the art could also be used.

In some embodiments, motorized tightening device 160 may be configured to regulate tension in tensile member 155 for purposes of tightening, loosening, and regulating the fit of upper 105 based on user input. In some embodiments, motorized tightening device 160 may be configured to automatically regulate tension in tensile member 155. Embodiments can incorporate a variety of sensors for providing information to a control unit of a motorized tensioning system. In some embodiments an H-bridge mechanism may be used to measure current. The measured current may be provided as an input to the control unit. In some cases, a predetermined current may be known to correspond to a certain level of tension in the tensile member. By checking the measured current against the predetermined current, a motorized tensioning system may adjust the tension of the tensile member until the predetermined current is measured, which indicates the desired tension has been achieved.

With current as a feedback, a variety of digital control strategies can be used. For instance, proportional control only could be used. Alternatively, PI control could be used or full PID. In cases some cases, simple averaging could be used or other filtering techniques including fuzzy logic and band-pass to reduce noise.

Still other embodiments can include additional types of sensors. In some cases, pressure sensors could be used under the insoles of an article to indicate when the user is standing. A motorized tensioning system can be programmed to automatically loosen the tension of the lace when the user moves from the standing position to a sitting position. Such a configuration may be useful for older adults that may require low tension when sitting to promote blood circulation but high tension for safety when standing.

Still other embodiments could include additional tension sensing elements. In one embodiment, three point bend indicators could be used in the lace to more accurately monitor the state of the tensioning system, including the lace. In other embodiments, various devices to measure deflection such as capacitive or inductive devices could be used. In some other embodiments, strain gauges could be used to measure tension induced strain in one or more components of a tensioning system.

In some embodiments, sensors such as gyroscopes and accelerometers could be incorporated into a tensioning system. In some embodiments, an accelerometer and/or gyroscope could be used to detect sudden moment and/or position information that may be used as feedback for adjusting lace tension. These sensors could also be implemented to control periods of sleep/awake to extend battery life. In some cases, for example, information from these sensors could be used to reduce tension in a system when the user is inactive, and increase tension during periods of greater activity.

Some embodiments may use memory (for example onboard memory associated with a control unit) to store sensed data over time. This data may be stored for later upload and analysis. For example, one embodiment of an article of footwear may sense and store tension information over time that can be later evaluated to look at trends in tightening.

It is also contemplated that some embodiments could incorporate pressure sensors to detect high pressure regions that may develop during tightening. In some cases, the tension of the lace could be automatically reduced to avoid such high pressure regions. Additionally, in some cases, a system could prompt a user to alter them to these high pressure regions and suggest ways of avoiding them (by altering use or fit of the article).

It is contemplated that in some embodiments a user could be provided with feedback through motor pulsing, which generates haptic feedback for the user in the form of vibrations/sounds. Such provisions could facilitate operation of a tensioning system directly, or provide haptic feedback for other systems in communication with a motorized tightening device.

Various methods of automatically operating a motorized tightening device in response to various inputs can be used. For example, after initially tightening a shoe, it is common for the lace tension to quickly decline in the first few minutes of use. Some embodiments of a tensioning system may include provisions for readjusting lace tension to the initial tension set by the user. In some embodiments, a control unit may be configured to monitor tension in those first minutes to then readjust tension to match original tension.

Power source 420 may be configured to supply power to motorized tightening device 160. In some embodiments, power source 420 may include one or more batteries. Power source 420 shown in FIG. 1 is only intended as a schematic representation of one or more types of battery technologies that could be used to power motorized tightening device 160. One possibly battery technology that could be used is a lithium polymer battery. The battery (or batteries) could be rechargeable or replaceable units packaged as flat, cylindrical, or coin shaped. In addition, batteries could be single cell or cells in series or parallel.

Rechargeable batteries could be recharged in place or removed from an article for recharging. In some embodiments, charging circuitry could be built in and on board. In other embodiments, charging circuitry could be located in a remote charger. In another embodiment, inductive charging could be used for charging one or more batteries. For example, a charging antenna could be disposed in a sole structure of an article and the article could then be placed on a charging mat to recharge the batteries.

Additional provisions could be incorporated to maximize battery power and/or otherwise improve use. For example, it is also contemplated that batteries could be used in combination with super caps to handle peak current requirements. In other embodiments, energy harvesting techniques could be incorporated which utilize the weight of the runner and each step to generate power for charging a battery.

In order to accommodate control unit 415 and power source 420, midsole 112 may include at least one recess 410 on a lower side 405 of midsole 112. Recess 410 may be configured to receive control unit 415 and power source 420. Control unit 415 and power source 420 may be removably disposed in recess 410. For example, in some embodiments, control unit 415 and power source 420 may be press-fit, interference fit, clipped, or fastened with temporary adhesive into recess 410. In some embodiments, recess 410 may include a removable cover (not shown) for containing control unit 415 and power source 420 within recess 410.

Figure 5:
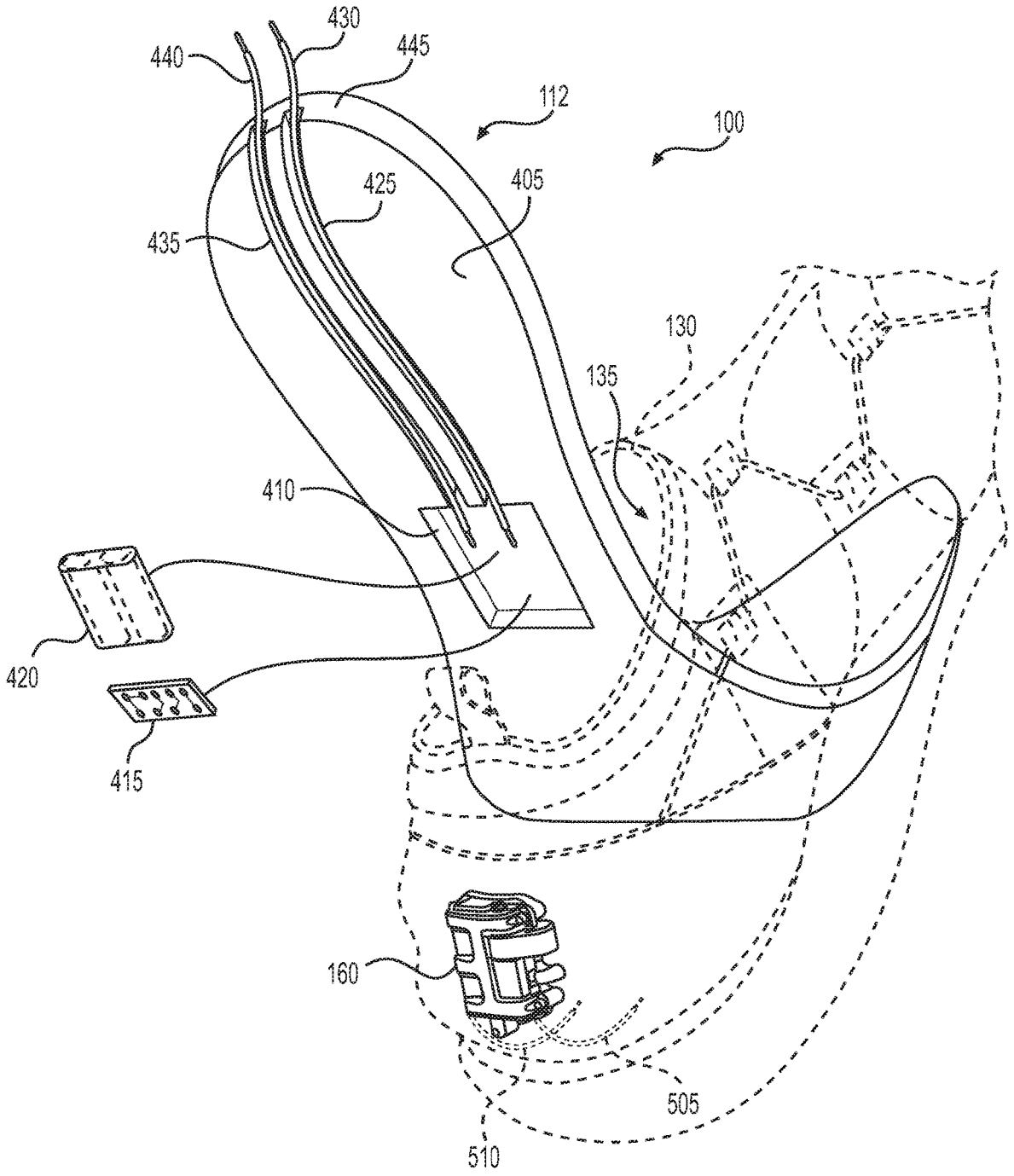
FIG. 5 is a schematic illustration of a rear perspective view of the removable midsole shown in FIG. 4 partially inserted into an article of footwear including a tightening device.

In addition lower side 405 of midsole 112 may include one or more grooves extending from recess 410 to a rear portion 445 of midsole 112 for containing electrical wires extending between the tightening device and the power source or the control unit. For example, as shown in FIG. 4, in some embodiments, midsole 112 may include a first groove 425 and a second groove 435. As shown in FIG. 4, first groove 425 may be configured to receive a first wire 430 extending from control unit 415. In addition, second groove 435 may be configured to receive a second wire 440 extending from power source 420, FIG. 5 is a schematic illustration of a rear perspective view of removable midsole 112 shown partially inserted into footwear 100. As shown in FIG. 5, midsole 112 may be configured to be inserted and removed from footwear 100 through opening 130.

As further shown in FIG. 5, one or more electrical wires may extend from tightening device 160 to power source 420 and control unit 415. For example, tightening device 160 may include a first lead wire 505 and a second lead wire 510. First lead wire 505 and second lead wire 510 may be configured to pass through the upper into void 135, in order to make connections with first wire 430 and second wire 440, respectively. FIG. 5 also shows first wire 430 and second wire 440 disposed in first groove 425 and second groove 435.

Thus, the tensioning system may include one or more electrical wires extending from the tightening device and one or more wires extending from the power source or the control unit. Further, in some embodiments, the tensioning system may include one or more releasable connectors configured to selectively connect the electrical wires extending from the tightening device with the one or more wires extending from the power source or the control unit.

Figure 6:
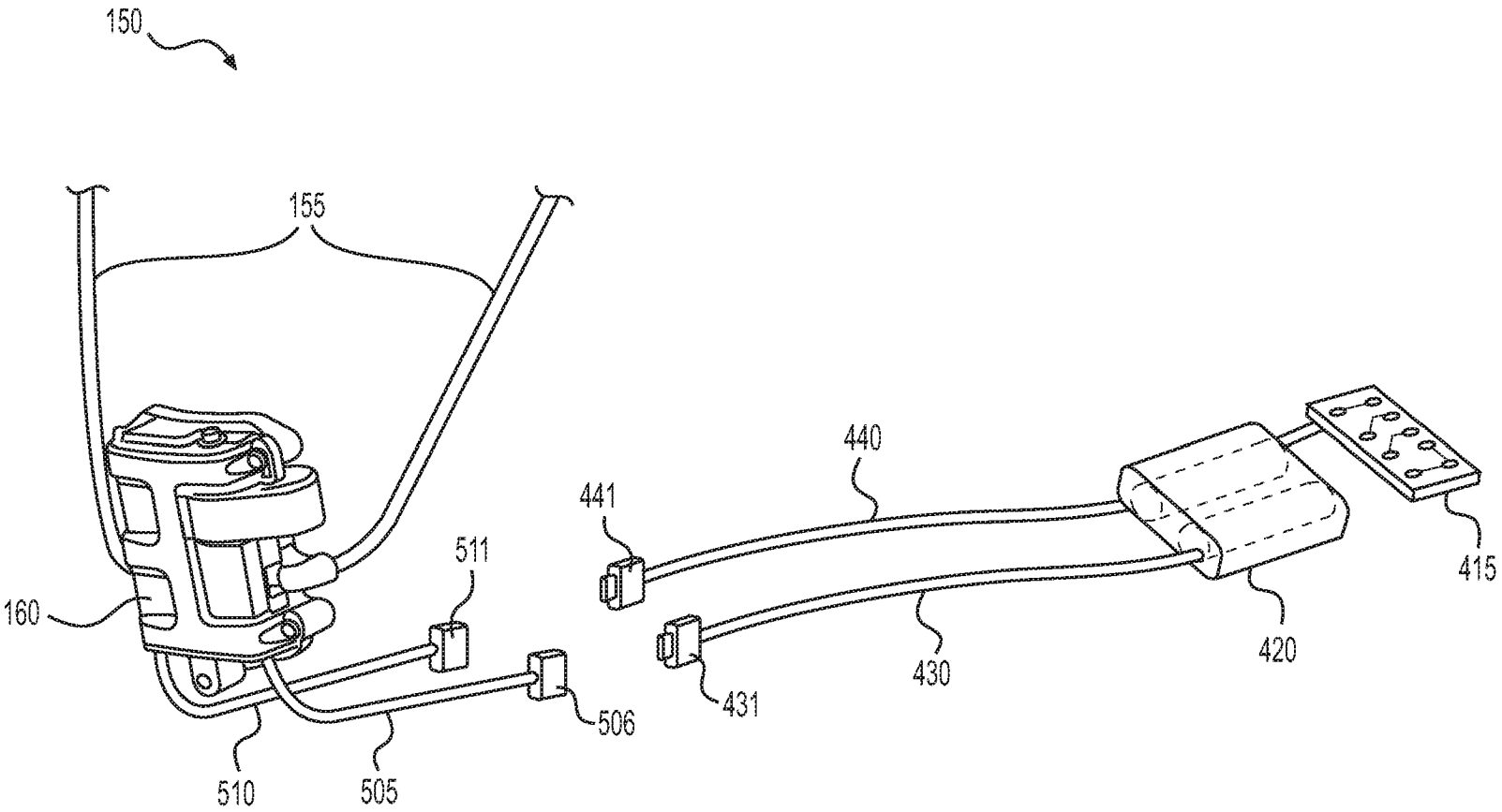
FIG. 6 is a schematic illustration of components of a motorized tensioning system for an article of footwear.

FIG. 6 is a schematic illustration of components of tensioning system 150. As shown in FIG. 6, first lead wire 505 may include a first releasable connector 506 and second lead wire 510 may include a second releasable connector 511. Similarly, first wire 430 may include a third releasable connector 431, which may be configured to releasably connect with first releasable connector 506. In addition, second wire 440 may include a fourth releasable connector 441, which may be configured to releasably connect with second releasable connector 511.

These releasable connectors may facilitate the replacement of power source 420 and control unit 415. The placement of these connectors may be proximate to the heel of the footwear. In other embodiments, these connectors may be disposed within the recess in the midsole. It will be noted, however, that other locations may also be suitable for these releasable wire connectors.

Components of motorized tensioning system 150 may have any suitable configurations. For example, components of motorized tensioning system 150 may have any suitable configurations disclosed in Beers, U.S. Pat. No. 9,693,605, issued Jul. 4, 2017 (now U.S. patent application Ser. No. 14/032,524, filed Sep. 20, 2013) and entitled "Footwear Having Removable Motorized Adjustment System," the entire disclosure of which is incorporated herein by reference.

In some embodiments, one or more components of the tensioning system may be tamper-resistant. That is, access to one or more of the components may be prevented unless a portion of the article of footwear or the tensioning system is destroyed. For example, in some embodiments, the tightening device may be sealed in a housing. Provisions may be made, however, to facilitate recycling of the tightening device. For example, a portion of the housing may be formed of a material that may be cut with reasonable ease to gain access to the tightening device, which may be removably attached to the upper.

Figure 7:
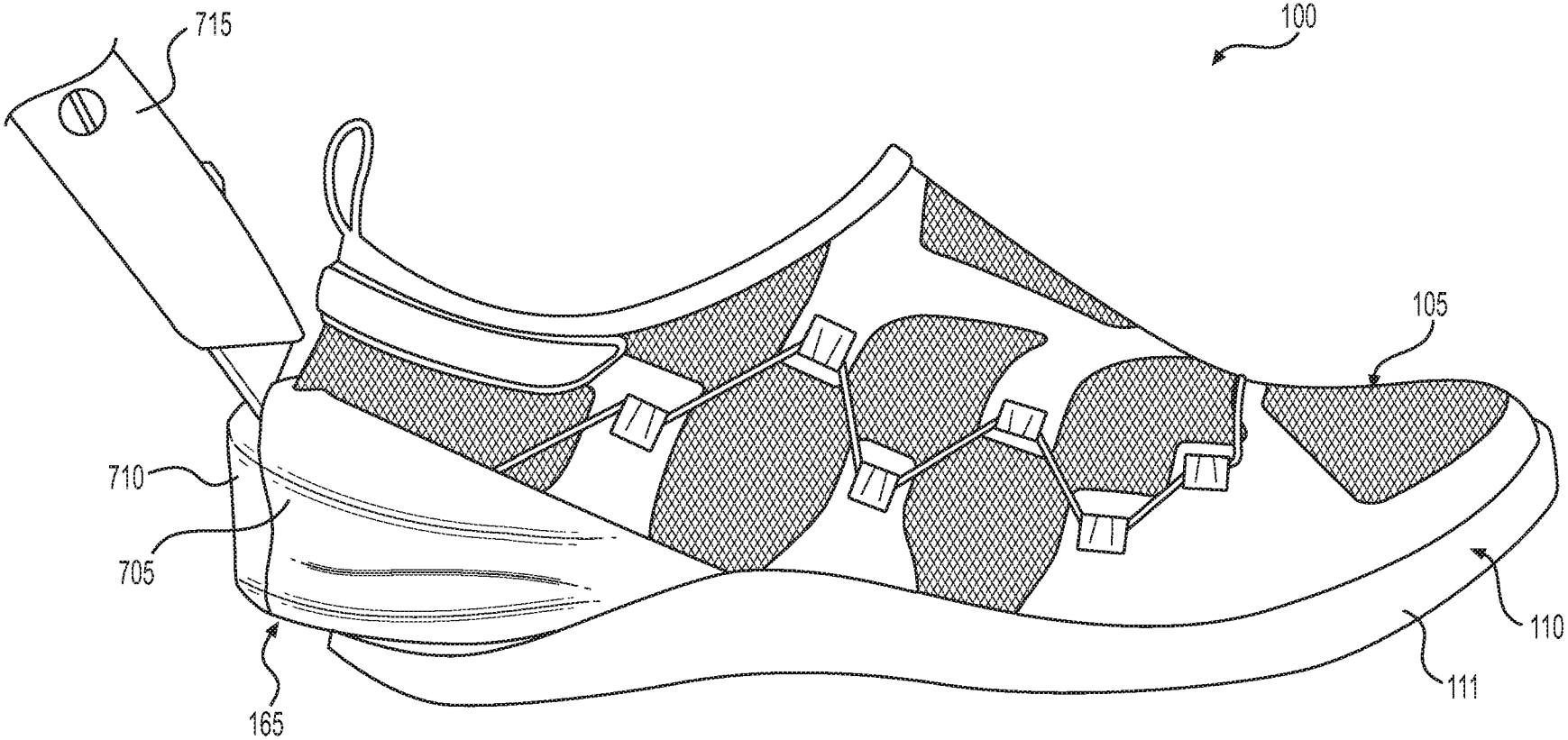
FIG. 7 is a schematic illustration of a side view of the article of footwear shown in FIG. 1, with a tightening device housing being cut open.

FIG. 7 is a schematic illustration of a side view of footwear 100, shown with tightening device housing 165 being cut open. In some embodiments, tightening device housing 165 may have a tamper-resistant construction. For example, tightening device housing 165 may include a first portion 705 formed of a first, substantially rigid plastic, and a second portion 710 formed of a second material fixedly attached to first portion 705. In some embodiments, second portion 710 may be configured to be destructively opened to provide access for removal of the tightening device. For example, as shown in FIG. 7, a cutting device, such as a utility knife 715, may be used to cut through second portion 710 or to separate second portion 710 from first portion 705 of tightening device housing 165.

Thus, assembly of footwear 100 may include fixedly attaching first portion 705 of tightening device housing 165 to the outer surface of upper 105 around the tightening device. In addition, the method of assembly may include fixedly attaching second portion 710 of tightening device housing 165 to first portion 705 of tightening device housing 165 to enclose the tightening device within tightening device housing 165. Due to the fixed attachment of second portion 710 to first portion 705 of tightening device housing 165, the housing may be substantially tamper-resistant.

Figure 8:
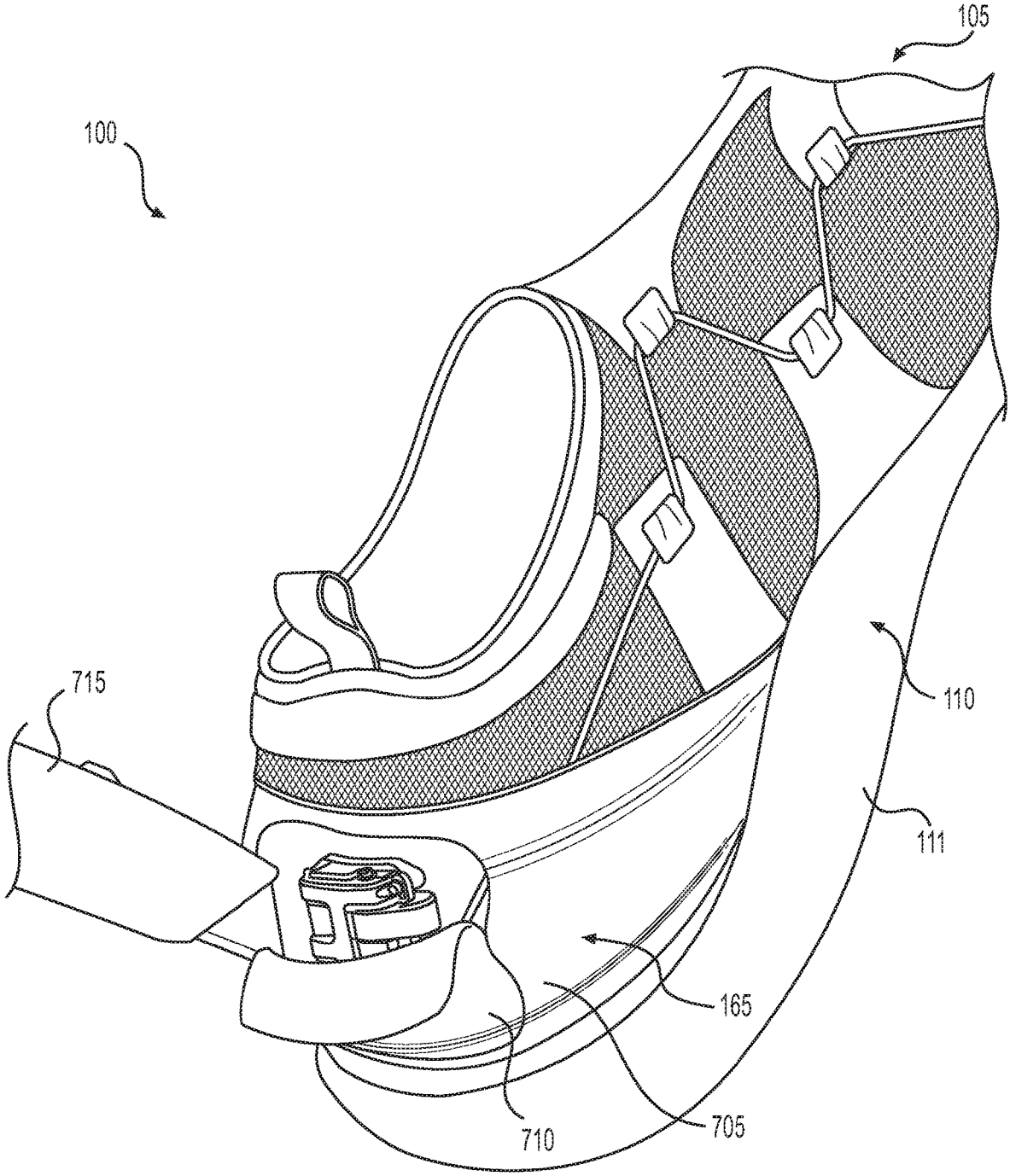
FIG. 8 is a schematic illustration of a rear perspective view of the article of footwear shown in FIG. 1, with a tightening device housing being cut open.
Figure 9:
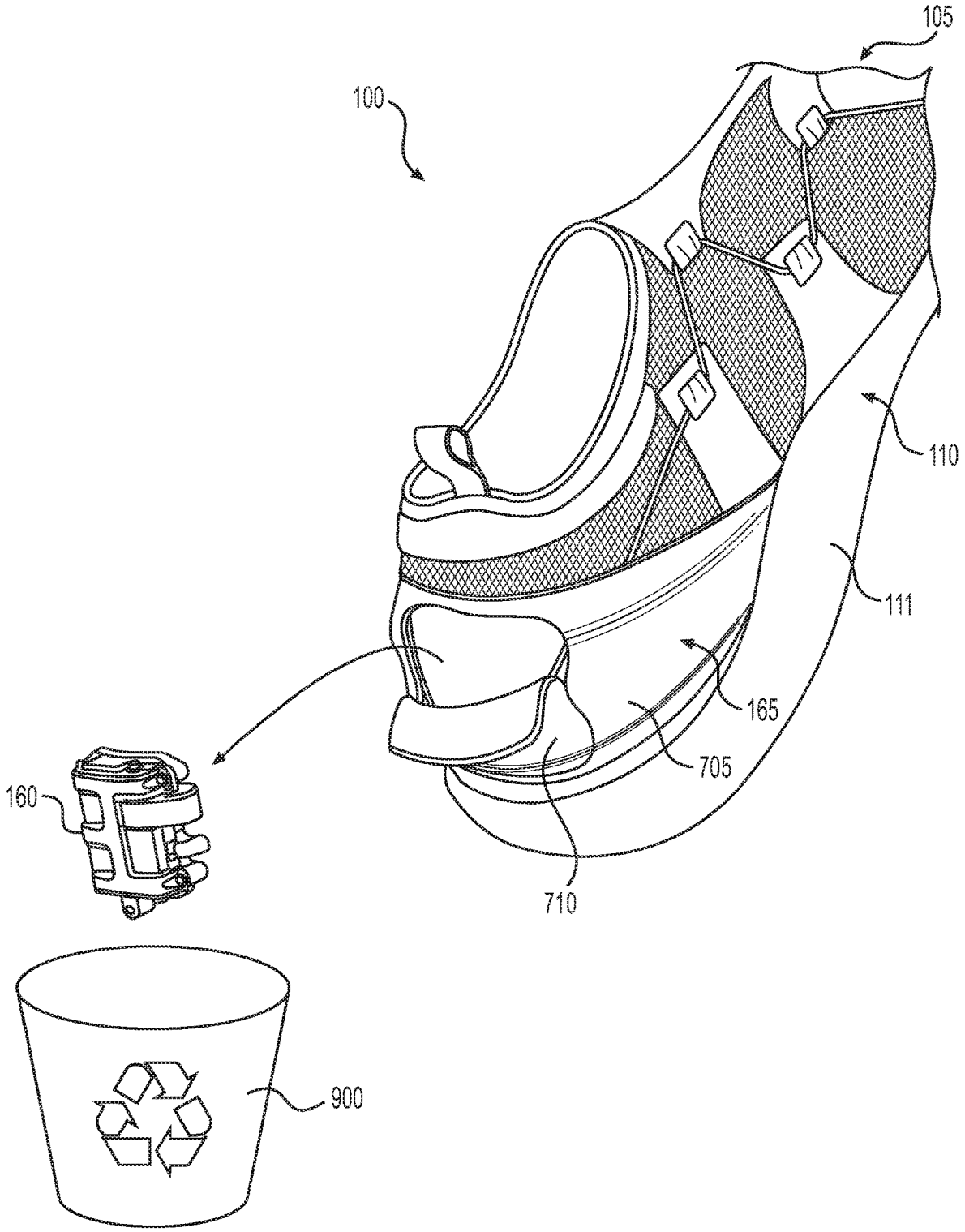
FIG. 9 is a schematic illustration of a rear perspective view of the article of footwear shown in FIG. 1, with a tightening device being removed.

FIG. 8 is a schematic illustration of a rear perspective view of footwear 100 shown with tightening device housing 165 being cut open by utility knife 715. As shown in FIG. 8, cutting open tightening device housing 165 may gain access to the compartment within the housing. After cutting away a substantial portion of second portion 710 of tightening device housing 165, tightening device 160 may be removed from its attachment to upper 105. For example, as shown in FIG. 9, tightening device 160 may be removed from tightening device housing 165 and footwear 105. As further shown in FIG. 9, tightening device 160 may be removed in this manner, for example, for purposes of recycling, as indicated by a recycling bin 900. This facilitated access to remove tightening device 160 may be beneficial, because it may facilitate separate recycling of tightening device 160 and footwear 105.

Because upper 105 may include elastic portions 145, a stretch-to-fit configuration may be used. That is, for a given standard shoe size, the cavity defined by upper 105 may be formed to have a volume smaller than the volume of the majority of wearer's feet having the given standard shoe size. For example, in some embodiments, for a given standard shoe size, the cavity may have a volume that is smaller than approximately 90 percent of wearer's feet having the given standard shoe size. In other embodiments, the percentage of wearer's feet that the cavity has a smaller volume than may vary, and thus, may be more or less than 90 percent.

Having a smaller internal cavity, upper 105 may expand when inserting the foot into footwear 100. The result is an upper that fits much like a sock, conforming to virtually all of the contours of the foot. In addition, because the stretch-to-fit configuration includes an upper that fits the foot in a stretched manner, this configuration provides an elastic binding of the upper against the foot, by virtue of the upper's elastic bias. Accordingly, in some embodiments, such an upper may be provided without a closure mechanism (for example, laces, straps, or other closure systems).

Figure 10:
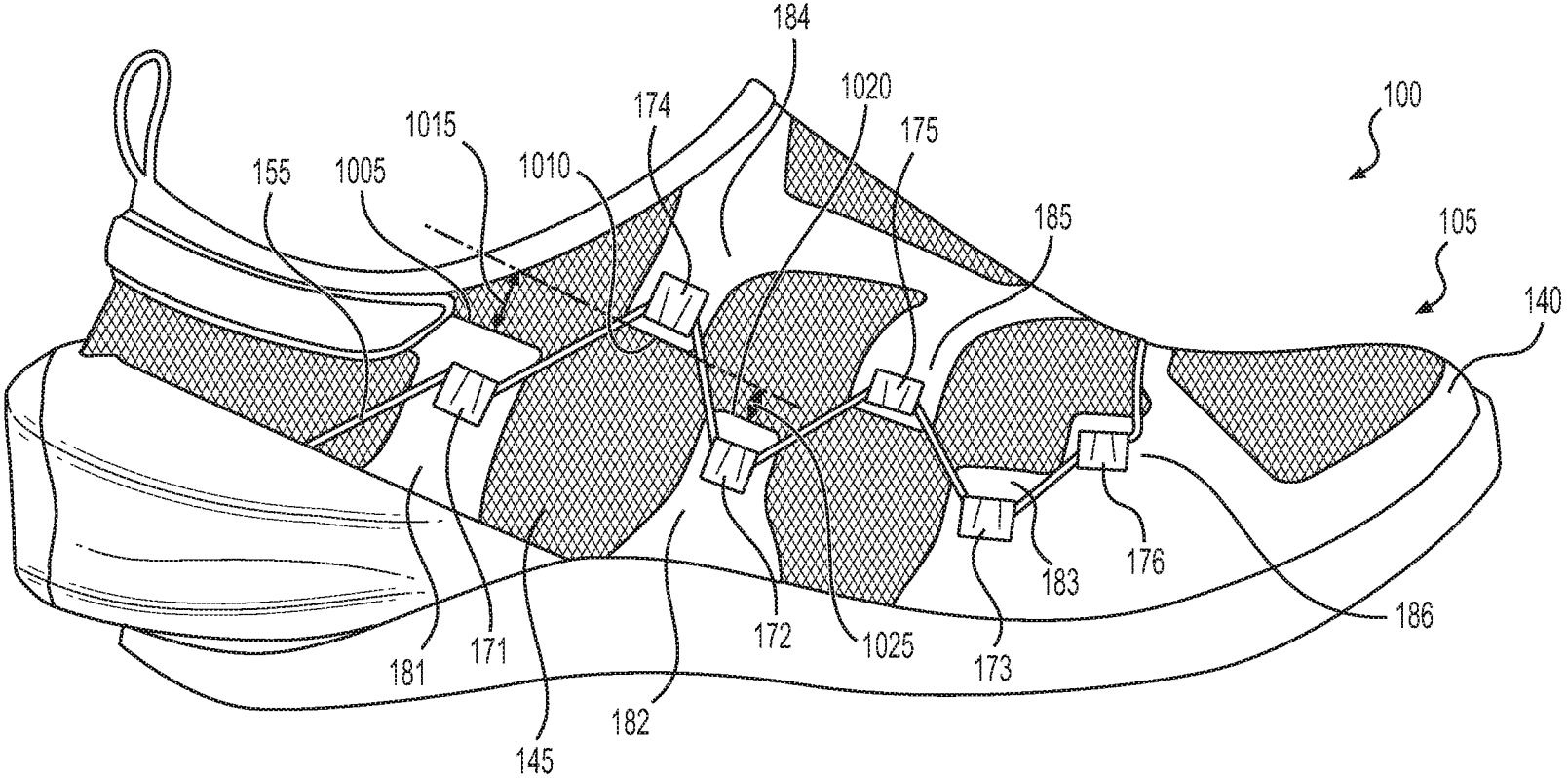
FIG. 10 is a schematic illustration of a side view of an article of footwear including a motorized tensioning system with an upper in an unstretched configuration.
Figure 11:
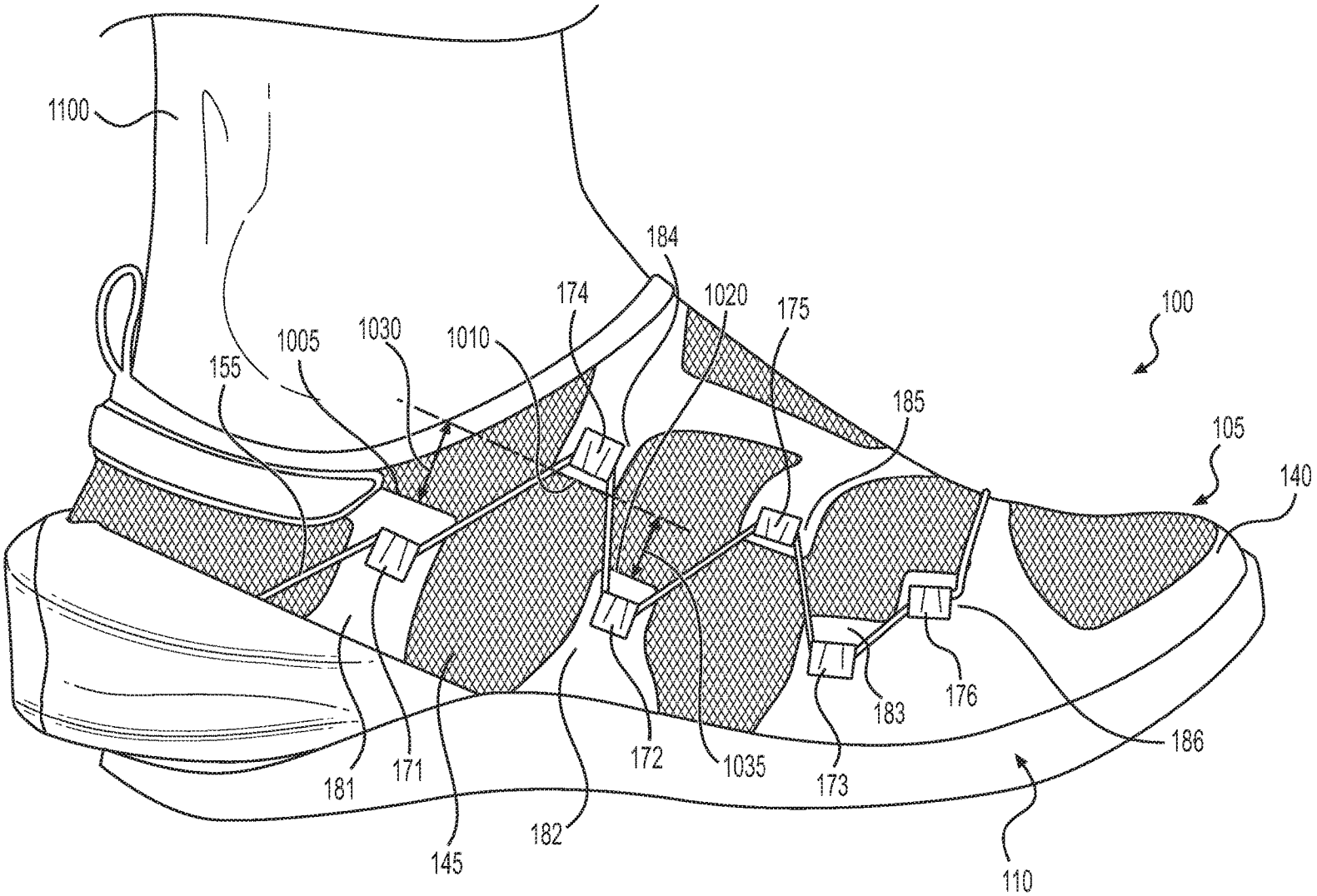
FIG. 11 is a schematic illustration of a side view of the article of footwear shown in FIG. 10 with a foot inserted into the article of footwear expanding elastic portions of the upper.
Figure 12:
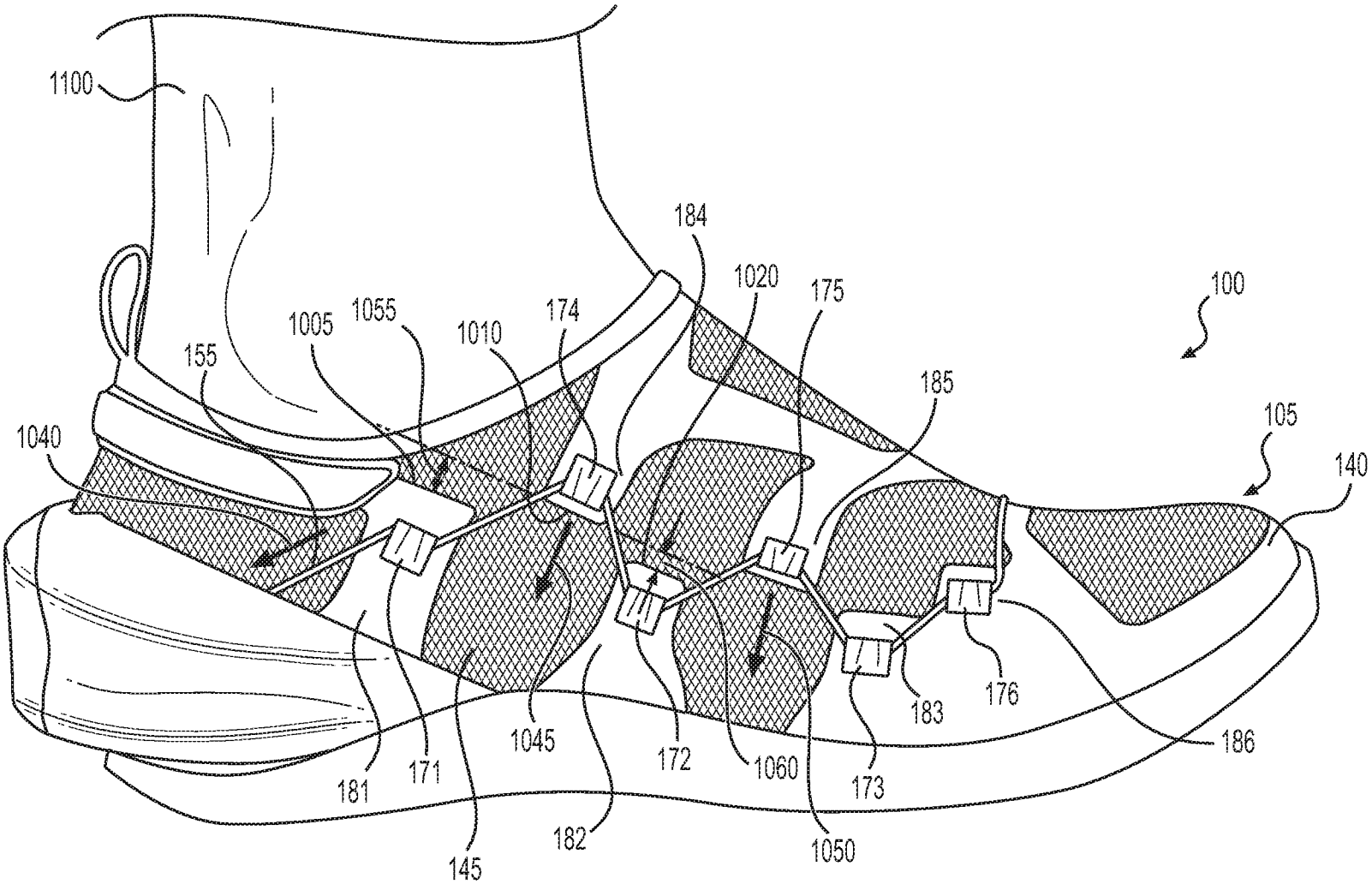
FIG. 12 is a schematic illustration of the article of footwear shown in FIG. 11 with the tensile member tightened, reducing the amount to which the elastic portions of the upper are stretched.

FIGS. 10-12 illustrate exemplary use of the tensioning system to adjust the fit of footwear 100, using the stretch-to-fit configuration. FIG. 10 is a side view of footwear 100 with upper 105 in an unstretched configuration. That is, elastic portions 145 of upper 105 are in a relaxed, unstretched state.

As shown in FIG. 10, first substantially inelastic portion 181 may have a first upper edge 1005. Second substantially inelastic portion 182 may have a second upper edge 1020. Fourth substantially inelastic portion 184 may have a lower edge 1010. As shown in FIG. 10, in the unstretched configuration of upper 105, first upper edge 1005 and lower edge 1010 may be separated by a first unstretched distance 1015. Similarly, in the unstretched configuration, second upper edge 1020 may be separated from lower edge 1010 by a second unstretched distance 1025.

As shown in FIG. 10, tensile member 155 may extend along a side of upper 105 in an oscillating pattern between staggered lace receiving members. Applying tension on tensile member 155 biases tensile member 155 toward a straight configuration, thus drawing the staggered lace receiving members (and the substantially inelastic portions of the upper to which the lace receiving members are attached) toward one another, FIG. 11 shows footwear 100 in a stretched configuration with a foot 1100 inserted into footwear 100 expanding elastic portions 145 of upper 105. That is, the interior volume of the cavity may increase as foot 1100 acts to substantially stretch elastic portions 145 beyond their initial unstretched state of elastic shown in FIG. 10).

As shown in FIG. 11, foot 1100 has pulled upwards on the instep region of footwear 100, pulling substantially inelastic portions 140 of footwear away from each other, thereby stretching elastic portions 145. For example, first upper edge 1005 and lower edge 1010 may be separated by a first stretched distance 1030. As shown in FIG. 11, first stretched distance 1030 is greater than first unstretched distance 1015. Similarly, second upper edge 1020 may be separated from lower edge 1010 by a second stretched distance 1035. As shown in FIG. 11, second stretched distance 1035 may be greater than second unstretched distance 1025.

As shown in FIG. 11, first substantially inelastic portion 181, second substantially inelastic portion 182, and third substantially inelastic portion 183 may be fixedly attached to sole structure 110. Fourth substantially inelastic portion 184, fifth substantially inelastic portion 185, and sixth substantially inelastic portion 186 may be located closer to an instep region of footwear 100. In addition, fourth substantially inelastic portion 184, fifth substantially inelastic portion 185, and sixth substantially inelastic portion 186 may be separated from first substantially inelastic portion 181, second substantially inelastic portion 182, and third substantially inelastic portion 183 by a spans of elastic material 145. Accordingly, while first substantially inelastic portion 181, second substantially inelastic portion 182, and third substantially inelastic portion 183 may remain anchored to sole structure 110, fourth substantially inelastic portion 184, fifth substantially inelastic portion 185, and sixth substantially inelastic portion 186 may be movable relative to first substantially inelastic portion 181, second substantially inelastic portion 182, and third substantially inelastic portion 183 by the stretch of elastic material 145 between the substantially inelastic portions caused by foot 1100 pulling upward on the instep region of footwear 100 and generally expanding the volume of footwear 100.

After putting footwear 100 on foot 1100, the tensioning system may be activated to apply tension to tensile member 155 to tighten the fit of footwear 100 as desired. Applying tension to tensile member 155 draws the staggered substantially inelastic portions of upper 105 toward one another by applying adjustment force to the first lace receiving members fixedly attached to the substantially inelastic portions.

FIG. 12 shows footwear 100 with tensile member 155 tightened, as illustrated by a first arrow 1040. Upon pulling tensile member 155 in the direction of first arrow 1040, fourth substantially inelastic portion 184 may be drawn downward toward first substantially inelastic portion 181 and second substantially inelastic portion 182, as indicated by a second arrow 1045. In addition, fifth substantially elastic portion 185 may be drawn down toward second substantially elastic portion 182 and third substantially inelastic portion 183, as indicated by a third arrow 1050.

Upon tightening footwear 105 using the tensioning system, elastic portions 145 may be collapsed, allowing them to become less stretched. For example, as shown in FIG. 12, in the tightened configuration, first upper edge 1005 may be separated from lower edge 1010 by a first tightened distance 1055. First tightened distance 1055 may be smaller than first stretched distance 1030. Depending upon the preference of the wearer, first tightened distance 1055 may be made greater, the same, or smaller than first unstretched distance 1015. Also, in the tightened configuration, second upper edge 1020 may be separated from lower edge 1010 by a second tightened distance 1060. As shown in FIG. 12, second tightened distance 1060 may be smaller than second stretched distance 1035. Further, depending upon the preference of the wearer, first second distance 1060 may be made greater, the same, or smaller than second unstretched distance 1025.

Figure 13:
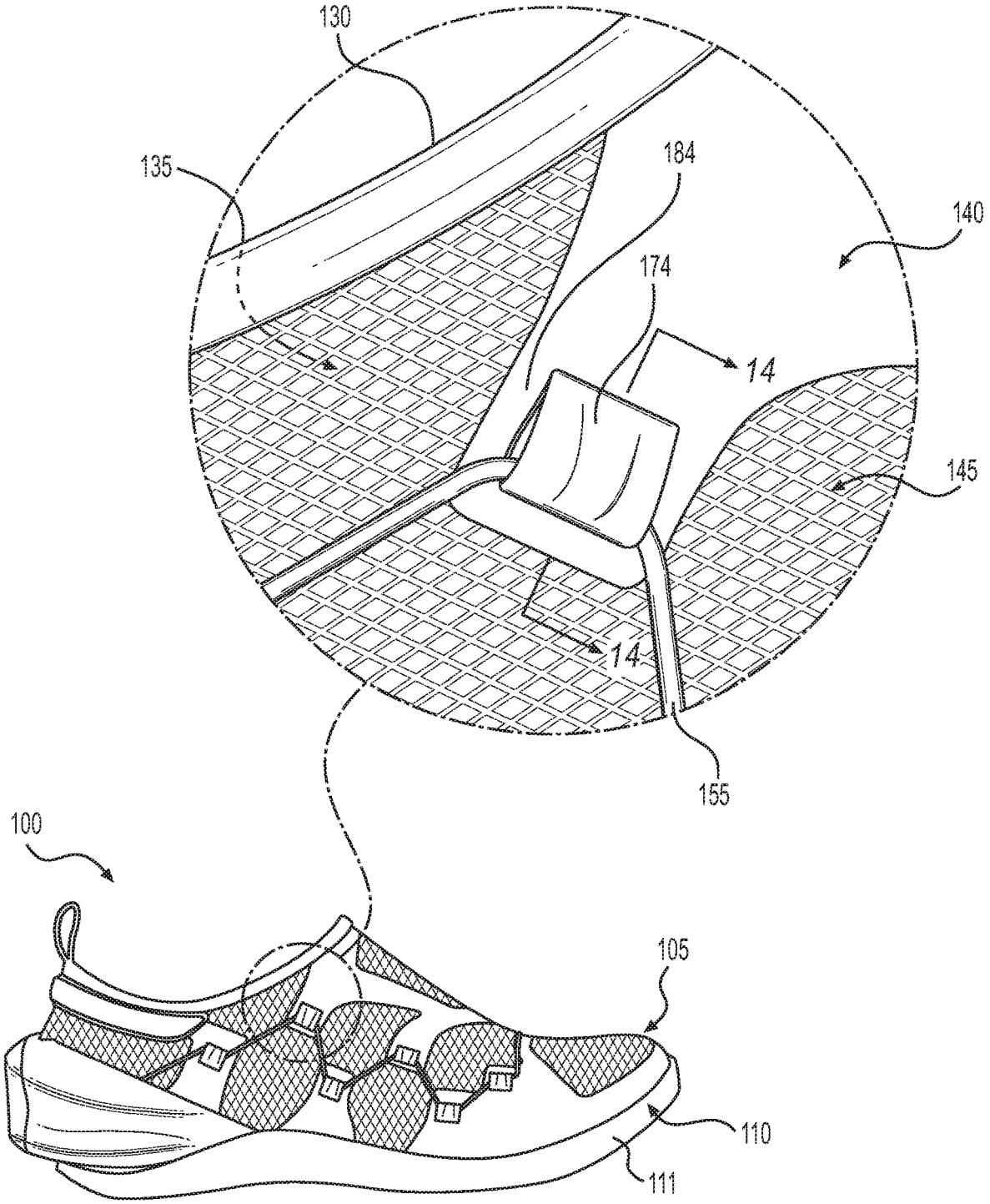
FIG. 13 is a schematic illustration of a lace receiving member of an article of footwear.

FIG. 13 is a schematic illustration of a lace receiving member of an article of footwear. As shown in FIG. 13, fourth lace receiving member 174 may be fixedly attached to fourth substantially inelastic portion 184. FIG. 13 further shows elastic portions 145 as a mesh. FIG. 13 also shows the void 135 defined by the upper, indicating that mesh elastic portions 145 may be ventilated.

Figure 14:
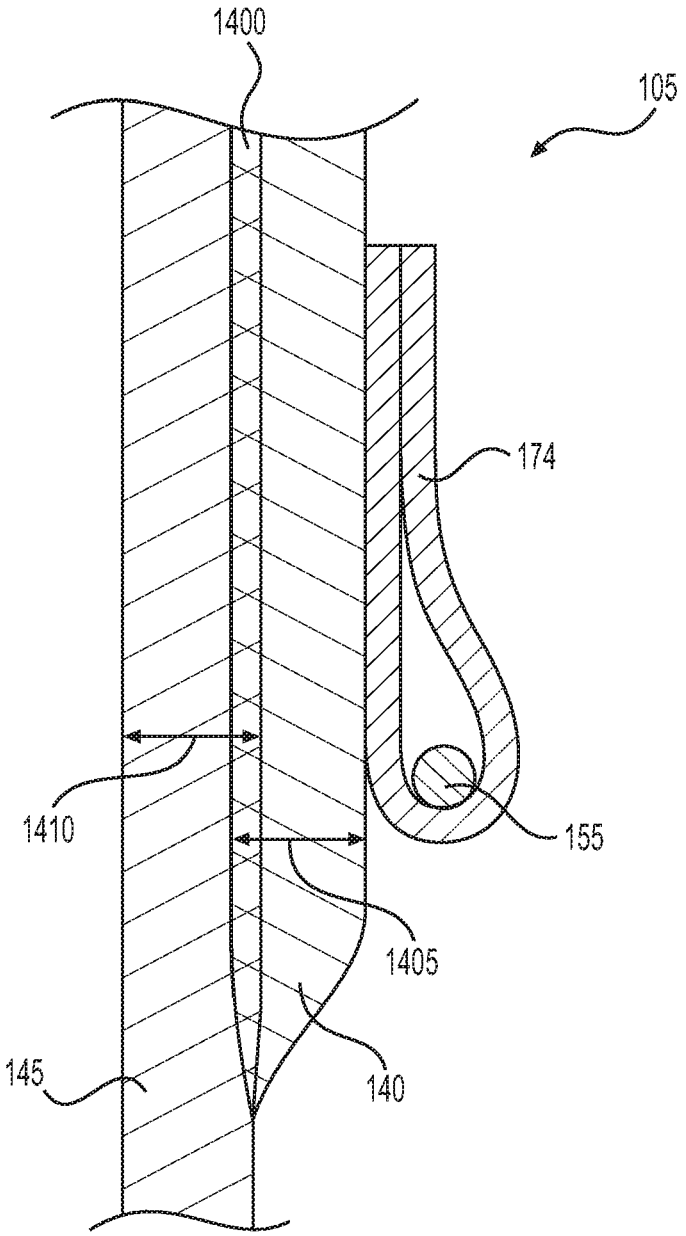
FIG. 14 is a schematic illustration of a cross-sectional view taken at section line 14-14 in FIG. 13.

FIG. 14 is a schematic illustration of a cross-sectional view taken at section line 14-14 in FIG. 13. FIG. 14 shows lace receiving member 174 as a loop receiving tensile member 155. As further shown in FIG. 14, elastic portions 145 of upper 105 may be fused to inelastic portions 140 of upper 105. The fusion of elastic portions 145 to substantially inelastic portions 140 is illustrated by a heat affected zone 1400, where materials from elastic portions 145 and substantially inelastic portions 140 are intermingled. For example, as shown in FIG. 14, substantially inelastic portions 1405 may have a first thickness 1405 and elastic portions 145 may have a second thickness 1410. As further shown in FIG. 14, first thickness 1405 may overlap second thickness 1410, thus forming heat affected zone 1400.

Figure 15:
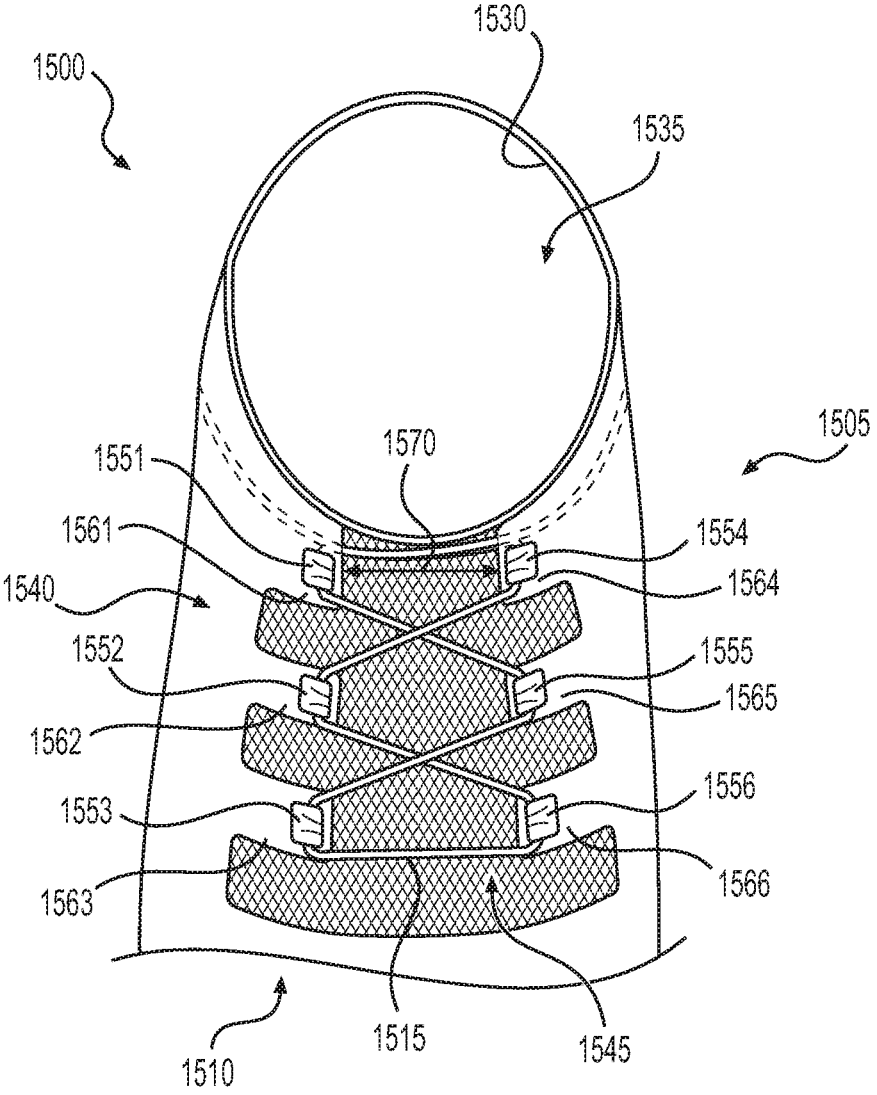
FIG. 15 is a schematic illustration of an upper front view of an article of footwear including elastic upper in an unstretched configuration.
Figure 16:
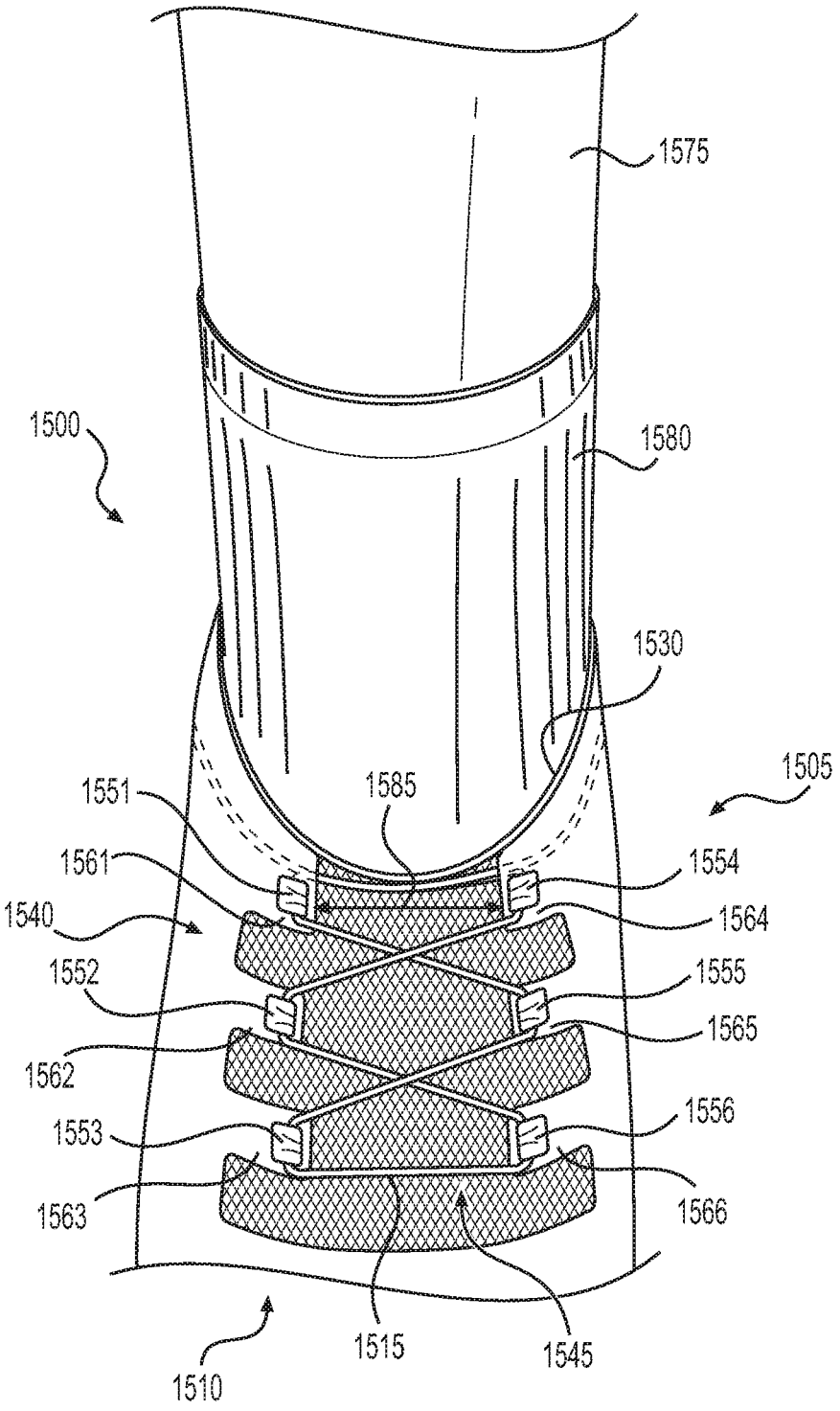
FIG. 16 is a schematic illustration of the article of footwear shown in FIG. 15 with a foot inserted into the article of footwear expanding the elastic portions of the upper.
Figure 17:
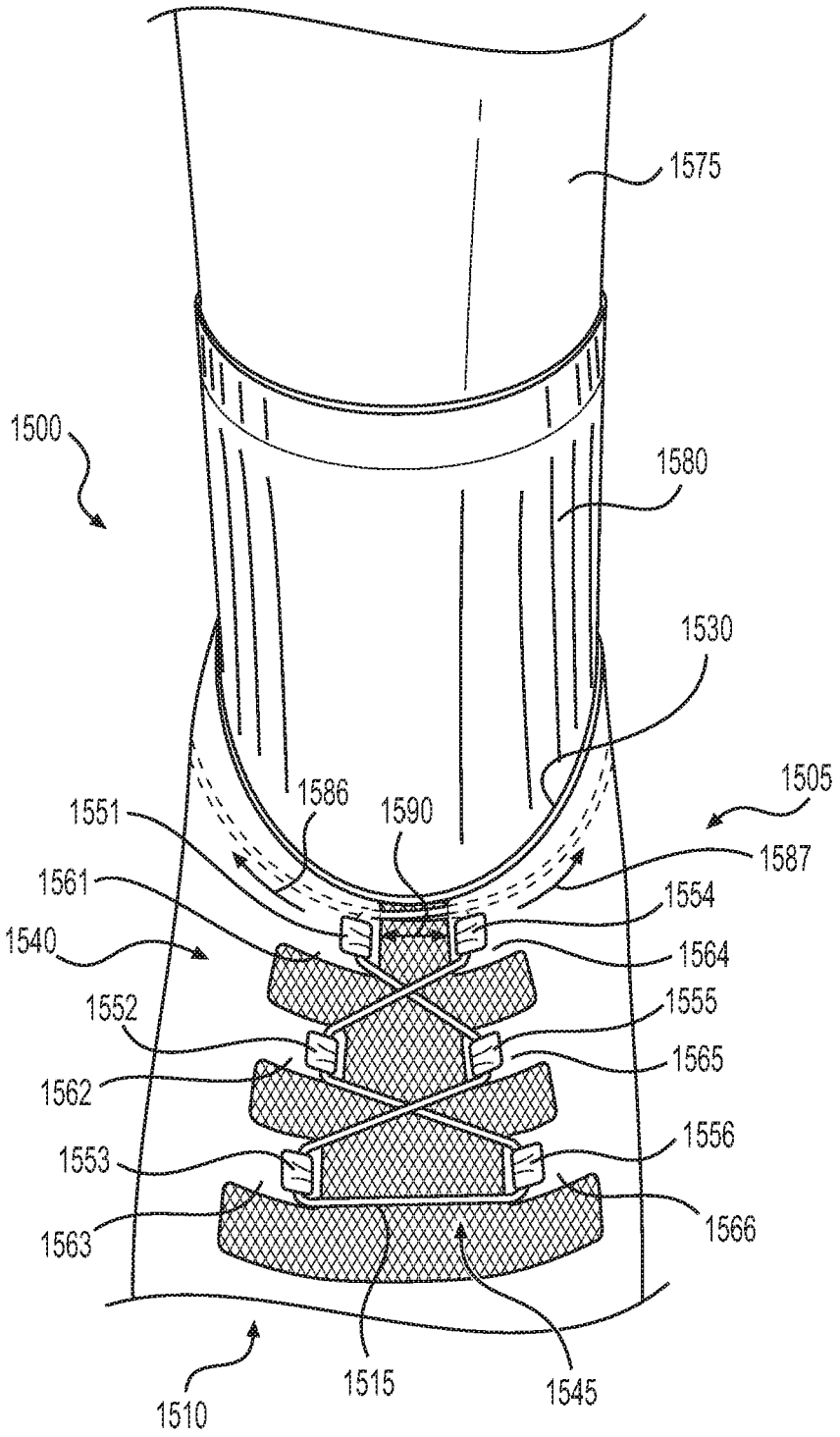
FIG. 17 is a schematic illustration of the article of footwear shown in FIG. 16 with the tensile member tightened, reducing the amount to which the elastic portions of the upper are stretched.

FIGS. 15-17 illustrate the operation of the tensioning system with an article of footwear 1500 having a stretch-to-fit configuration disposed in an instep region 1510. FIG. 15 is a schematic illustration of an upper front view of footwear 1500 in an unstretched configuration. As shown in FIG. 15, footwear 1500 may include an upper 1505. Upper 1505 may define a void 1535 configured to receive a foot via an opening 1530 also defined by upper 1505. Upper 1505 may include substantially inelastic portions 1540 and elastic portions 1545. These features of footwear 1500 may have the same or similar characteristics as other embodiments discussed herein.

As opposed to the staggered configuration shown in FIGS. 10-12, footwear 1500, shown in FIG. 15 may include opposing lace receiving members fixedly attached to opposing substantially inelastic portions. Accordingly, footwear 1500 may include a tensile member 1515, which may be attached to a motorized tensioning system (not shown). Further, tensile member 1515 may extend along an instep region of footwear 1500 in a criss-cross pattern between opposing lace receiving members.

For example, upper 1505 may include a first lace receiving member 1551 fixedly attached to a first substantially inelastic portion 1561. A second lace receiving member 1552 may be fixedly attached to a second substantially inelastic portion 1562. A third lace receiving member 1553 may be fixedly attached to a third substantially inelastic portion 1563. In addition, a fourth lace receiving member 1554 may be fixedly attached to a fourth substantially inelastic portion 1564. A fifth lace receiving member 1555 may be fixedly attached to a fifth substantially inelastic portion 1565. Also, a sixth lace receiving member 1556 may be fixedly attached to a sixth substantially inelastic portion 1566. As shown in FIG. 15, in the unstretched configuration, with no tension applied in a tensile member 1515, first substantially inelastic portion 1561 may be separated from laterally opposing fourth substantially inelastic portion 1564 by an unstretched distance 1570.

As shown in FIG. 16, inserting a foot of a wearer, indicated by a leg 1575 and a sock 1580, may expand the volume of the cavity defined by upper 1505, by stretching elastic portions 1545 of upper 1505. For example, as shown in FIG. 16, in a stretched configuration, first substantially inelastic portion 1561 may be separated from fourth substantially inelastic portion 1554 by a stretched distance 1585. As shown in FIG. 16, stretched distance 1585 may be greater than unstretched distance 1570.

As shown in FIG. 17, the wearer may adjust the tightness of footwear 1500 as desired by applying tension in tensile member 1515, as indicated by a first arrow 1586 and a second arrow 1587. Accordingly, in a tightened configuration, first substantially inelastic portion 1561 may be separated from fourth substantially inelastic portion 1564 by a tightened distance 1590. As shown in FIG. 17, tightened distance 1590 may be smaller than stretched distance 1585. In addition, depending on the wearer's preference, tightened distance 1590 may be smaller, the same, or greater than unstretched distance 1570.

Figure 18:
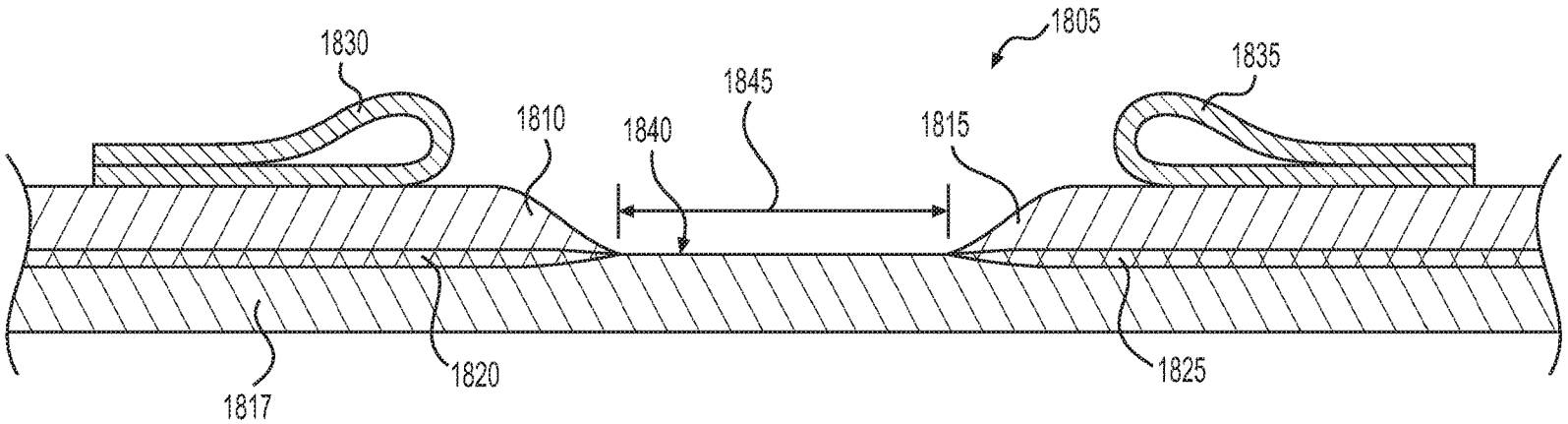
FIG. 18 is a schematic illustration of a cross-sectional view of a portion of a footwear upper including a continuous layer of upper material.

FIG. 18 is a schematic illustration of a cross-sectional view of a portion of a footwear upper 1805 including a continuous layer of upper material extending between lace receiving members. As shown in FIG. 18, upper 1805 may include a first substantially inelastic portion 1810 and a second substantially inelastic portion 1815 separated by a span 1845. A first lace receiving member 1830 may be fixedly attached to first substantially inelastic portion 1810, and a second lace receiving member 1835 may be fixedly attached to second substantially inelastic portion 1815.

Upper 1805 may further include an elastic layer 1817. Elastic layer 1817 may be fused to first substantially inelastic portion 1810, as indicated by a first heat affected zone 1820. In addition, elastic layer 1817 may be fused to second substantially inelastic portion 1815, as indicated by a second heat affected zone 1825. This configuration includes an elastic portion 1840 having span 1845. However, despite the differences in characteristics between the substantially inelastic portions and the elastic portion, the upper is "continuous" across these three areas by virtue of the layers being fused, and the materials being intermingled. Configurations such as that shown in FIG. 18 may be formed using, for example, a full length elastic layer, that extends substantially the entire form of the upper. (See FIG. 2.)

In some embodiments, the elastic layer may extend only between substantially inelastic portions of the upper, only slightly overlapping with the substantially inelastic layers. This may reduce weight, but eliminating additional elastic material.

Figure 19:
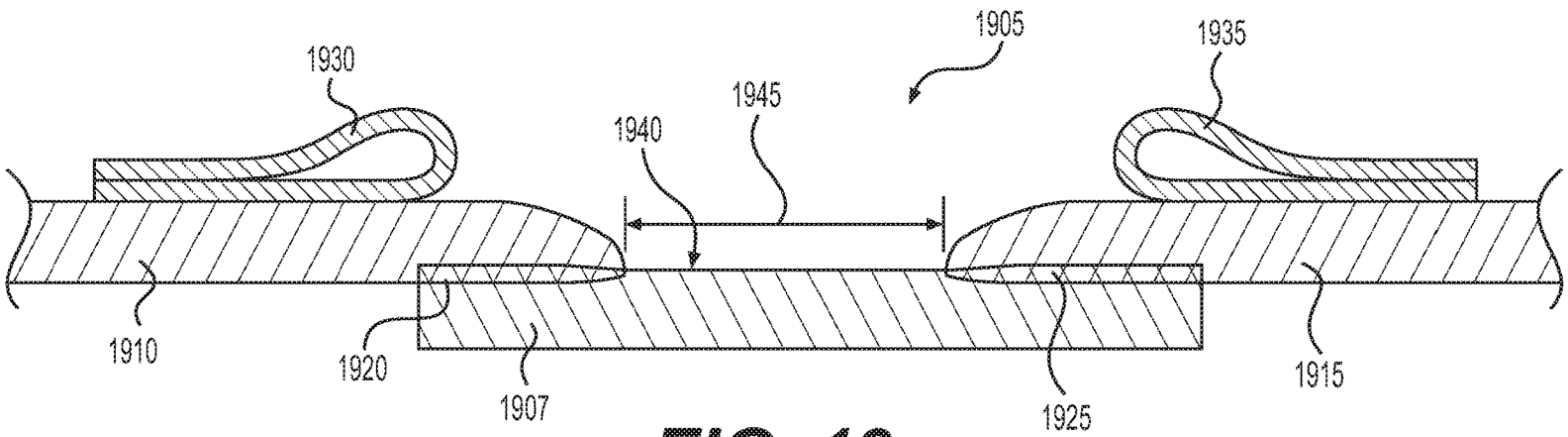
FIG. 19 is a schematic illustration of a cross-sectional view of a portion of a footwear upper including a layer of upper material extending between inelastic portions of the upper.

As shown in FIG. 19, an upper 1905 may be formed of a first substantially inelastic portion 1910 and a second substantially inelastic portion 1915 joined by an elastic layer 1907. Elastic portion 1907 may be fused to first substantially inelastic portion 1910, forming a first heat affected zone 1920. Elastic portion 1907 may also be fused to second substantially inelastic portion 1915, forming a second heat affected zone 1925. The substantially inelastic portions may be separated by an elastic portion 1940 of upper 1905 having a span 1945.

In some embodiments, buttons for tightening, loosening and/or performing other functions can be located directly on the footwear. As an example, some embodiments could incorporate one or more buttons located on or adjacent to the housing of a motorized tightening device. In still other embodiments, a motorized tightening device maybe controlled using voice commands. These commands could be transmitted through a remote device, or to a device capable of receiving voice commands that is integrated into the article and in communication with the motorized tightening device.

In some embodiments, the motorized tightening device may be configured to be controlled by a remote device. Accordingly, the footwear adjustment system may include a remote device configured to control the motorized tightening device. For example, in some embodiments, the remote device may include a bracelet, wristband, or armband that is worn by a user and specifically designed for communicating with the tensioning system.

In some embodiments, other types of mobile devices, such as mobile phones, may be configured to control the tensioning system. In some embodiments, the remote device may include a mobile phone, such as the iPhone made by Apple, Inc. In other embodiments, any other kinds of mobile phones could also be used including smartphones. In other embodiments, any portable electronic devices could be used including, but not limited to: personal digital assistants, digital music players, tablet computers, laptop computers, ultrabook computers as well as any other kinds of portable electronic devices. In still other embodiments, any other kinds of remote devices could be used including remote devices specifically designed for controlling the tensioning system. The type of remote device could be selected according to software and hardware requirements, ease of mobility, manufacturing expenses, as well as possibly other factors.

Figure 20:
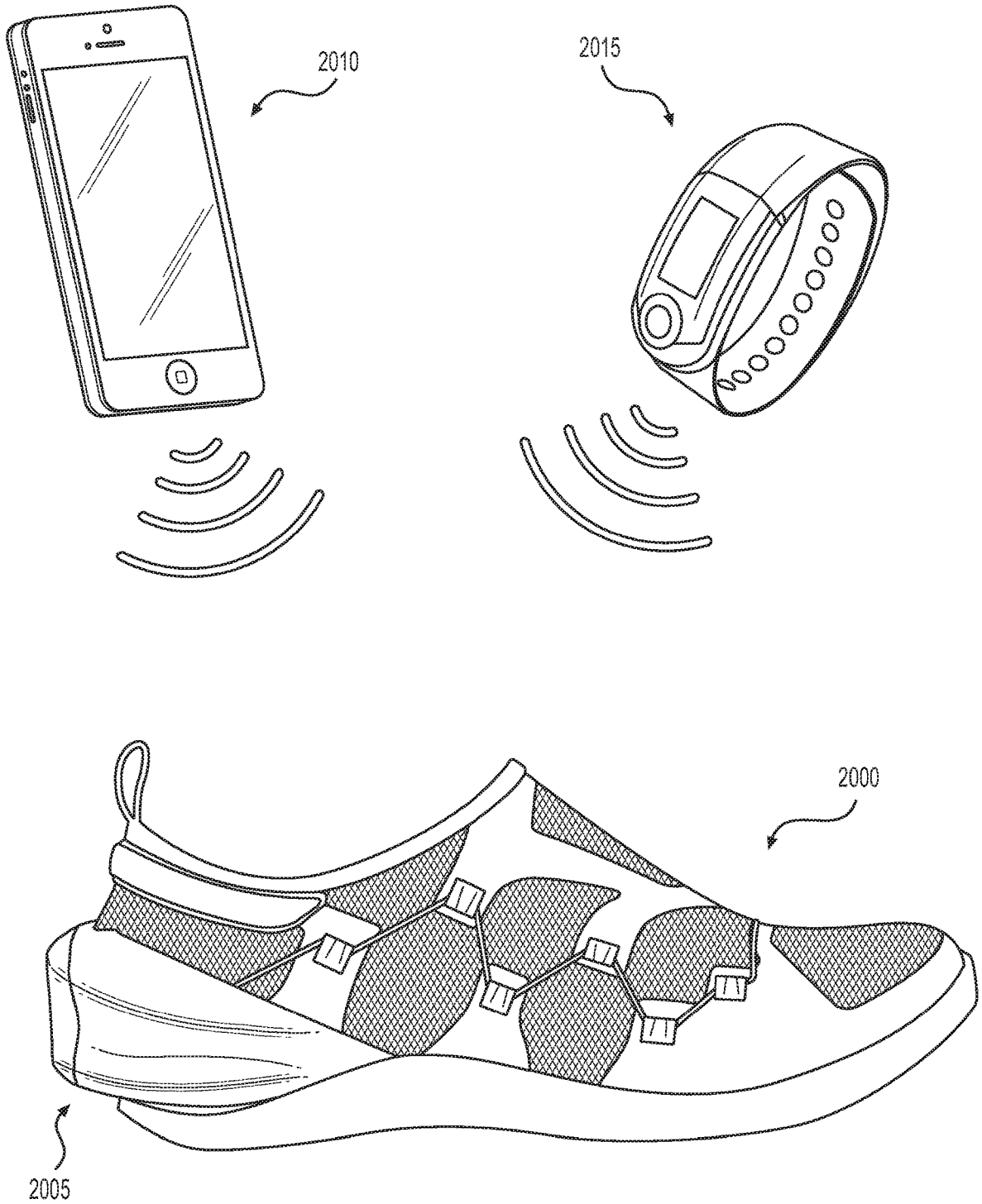
FIG. 20 is a schematic illustration of an article of footwear with a lace tensioning system and a remote device for controlling the tensioning system.

FIG. 20 is a schematic illustration of an article of footwear 2000 with a motorized tensioning system 2005. Footwear 2000 may have features that are the same or similar to other embodiments discussed above. For example, tensioning system 2005 may include a tightening device, a power source, and a control unit, as described above with respect to other disclosed embodiments.

In addition, as shown in FIG. 20, a footwear adjustment system may include footwear 2000 and a remote device for controlling tensioning system 2005. The remote device used with footwear 2000 may be any suitable device for communicating with tensioning system 2005. In some embodiments, the remote device may be a mobile phone 2010, as shown in FIG. 20. In some embodiments, the remote device may be a bracelet 2015, as also shown in FIG. 20. Further, in some embodiments, tensioning system 2005 may be configured to be operated with either or both of phone 2010 and bracelet 2015. In some embodiments, a remote device such as bracelet 2015 may be sold together with footwear 2000, for example, as a kit of parts. For instance, footwear 20 and bracelet 2015 may be included in the same container or packaging.

In some embodiments, the control unit of tensioning system 2005 may be configured to communicate with the remote device. In some cases, the control unit may be configured to receive operating instructions from the remote device. Accordingly, the remote device may be configured to communicate instructions to the control unit. Therefore, the control unit may be configured to receive instructions from the remote device to apply increased tension to the tensile member by winding the spool. In some cases, the remote device may be capable of receiving information from the control unit. For example, the remote device could receive information related to the current tension in the tensile member and/or other sensed information. Accordingly, in some embodiments, the remote device may function as a remote control that may be used by the wearer to operate the tensioning system.

Examples of different communication methods between the remote device and the tensioning system may include wireless networks such as personal area networks (e.g., Bluetooth®) and local area networks (e.g., Wi-Fi), as well as any kinds of RF based methods known in the art. In some embodiments, infrared light may be used for wireless communication. Although the illustrated embodiments detail a remote device that communicates wirelessly with the motorized tensioning system, in other embodiments the remote device and tensioning system may be physically connected and communicate through one or more wires.

The disclosed lace adjustment system may be usable to perform a variety of functions related to the tensioning of the tensile member. The tensioning system components and the remote device may be configured to perform any of the operative functions described in Beers, U.S. Pat. No. 9,693,605, issued Jul. 4, 2017 (now U.S. patent application Ser. No. 14/032,524, filed Sep. 20, 2013) and entitled "Footwear Having Removable Motorized Adjustment System," the entire disclosure of which is incorporated herein by reference.

While various embodiments of the invention have been described, the description is intended to be exemplary, rather than limiting and it will be apparent to those of ordinary skill in the art that many more embodiments and implementations are possible that are within the scope of the invention. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the invention is not to be restricted except in light of the attached claims and their equivalents. Also, various modifications and changes may be made within the scope of the attached claims.

What is claimed is:

1. A footwear assembly comprising:

a footwear upper including a toe box portion, a medial side, a lateral side, and a heel portion, the medial side and the lateral side each extending proximally from the toe box portion to the heel portion;

a lace cable with a first end anchored along a distal outside portion of the medial side and a second end anchored along a distal outside portion of the lateral side;

a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper;

a medial proximal lace guide routing the lace cable from the pattern formed by a medial portion of the plurality of lace guides into a position allowing the lace cable to engage a tightening device disposed within a mid-sole portion;

a lateral proximal lace guide to route the lace cable out of the position allowing the lace cable to engage the tightening device into the pattern formed by a lateral portion of the plurality of lace guides;

a first elastic portion extending between first and second lace guides of the plurality of lace guides;

a first inelastic portion extending along an upper side of the first elastic portion; and a second inelastic portion extending along a lower side of the first elastic portion;

wherein:

a first of the plurality of lace guides is positioned on the first inelastic portion;

a second of the plurality of lace guides is positioned on the second inelastic portion;

the first inelastic portion and the second inelastic portion are inelastically uncoupled from each other at least proximate a heel portion end of the upper; and the first elastic portion connects the medial proximal and lateral proximal lace guides via the first and second inelastic portions across a centerline portion of the footwear upper extending along a medial-lateral center of the footwear assembly.

2. The footwear assembly of claim 1, wherein the first elastic portion connects the medial proximal and lateral proximal lace guides via the first and second inelastic portions across the heel portion of the footwear upper at a posterior-most portion of the footwear upper.

3. The footwear assembly of claim 1, further comprising a second elastic portion extending between third and fourth lace guides of the plurality of lace guides.

4. The footwear assembly of claim 1, wherein the first elastic portion comprises a portion of the footwear upper.

5. The footwear assembly of claim 1, wherein the first lace guide and the second lace guide form first and second guide paths, respectively, that extend in anterior-posterior directions parallel to each other.

6. A footwear assembly comprising:

a footwear upper including a toe box portion, a medial side, a lateral side, and a heel portion, the medial side and the lateral side each extending proximally from the toe box portion to the heel portion;

a lace cable with a first end anchored along a distal outside portion of the medial side and a second end anchored along a distal outside portion of the lateral side;

a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper;

a medial proximal lace guide routing the lace cable from the pattern formed by a medial portion of the plurality of lace guides into a position allowing the lace cable to engage a tightening device disposed within a mid-sole portion;

a lateral proximal lace guide to route the lace cable out of the position allowing the lace cable to engage the tightening device into the pattern formed by a lateral portion of the plurality of lace guides; and a first elastic portion extending between first and second portions of the footwear upper; and wherein the first elastic portion comprises an elastic centerline portion extending along a medial-lateral center of the footwear assembly from at least the toe box portion proximally to a foot opening, and the first and second portions of the footwear upper comprise the medial and lateral sides, respectively.

7. The footwear assembly of claim 6, wherein the first elastic portion comprises an elastic heel portion extending proximate to a foot opening at a posterior-most end of the footwear upper, and the first and second portions of the footwear upper comprise medial and lateral sides of the heel portion, respectively.

8. The footwear assembly of claim 6, wherein a first portion of the plurality of lace guides are mounted to a first portion of the upper and a second portion of the plurality of lace guides are mounted to a second portion of the upper, wherein the first and second portions of the upper are inelastic, uncoupled from each other via inelastic portions of the footwear upper, and separated by the first elastic portion.

9. The footwear assembly of claim 6, wherein the first elastic portion can be opened or expanded to permit access to an interior space within the footwear upper.

10. A footwear assembly comprising:

a sole structure;

a footwear upper defining a toe box portion, a medial side, a lateral side, and a heel portion, the footwear upper connected to the sole structure to form an interior space for receiving a foot, the footwear upper forming a collar to permit access to the interior space;

a tightening device disposed proximate the sole structure;

a lacing system comprising:

a lace cable having medial and lateral ends anchored to the footwear upper and a middle portion passing through the lacing engine; and a plurality of lace guides for routing the lace cable along the footwear upper between the medial and lateral ends and the tightening device;

an elastic member coupled to the footwear assembly;

a first inelastic portion extending along an upper side of the first elastic portion; and a second inelastic portion extending along a lower side of the first elastic portion;

wherein:

a first of the plurality of lace guides is positioned on the first inelastic portion;

a second of the plurality of lace guides is positioned on the second inelastic portion; and the first elastic portion connects the medial proximal and lateral proximal lace guides via the first and second inelastic portions across a centerline portion of the footwear upper extending along a medial-lateral center of the footwear assembly.

11. The footwear assembly of claim 10, wherein the elastic portion is configured to stretch after the lacing engine has tightened the lace cable.

12. The footwear assembly of claim 10, wherein the elastic portion is stretchable relative to other portions of the footwear upper.

13. The footwear assembly of claim 10, wherein the elastic portion is configured to widen the collar.

14. The footwear assembly of claim 10, wherein the elastic portion connects the first and second inelastic portions such that the first and second inelastic portions are uncoupled via inelastic material.

15. The footwear assembly of claim 14, wherein the first and second lace guides are located on medial or lateral portions of the heel portion.

16. The footwear assembly of claim 14, wherein the first and second lace guides are located on the medial side or the lateral side of the footwear upper.

17. The footwear assembly of claim 14, wherein the first and second lace guides comprise loops of material attached to the footwear upper configured to receive the lace cable in anterior-posterior directions.

18. The footwear assembly of claim 10, wherein the first inelastic portion connects a first lace guide of the plurality of lace guides to a first portion of the footwear upper.

19. The footwear assembly of claim 18, wherein the first lace guide is located on either the medial or lateral side of the footwear upper and the first portion of the shoe upper is located on the heel portion.

20. The footwear assembly of claim 18, wherein the first lace guide and the first portion of the shoe upper are located on either the medial or lateral side of the footwear upper, and the first portion of the shoe upper is located at a throat of the footwear upper.

21. The footwear assembly of claim 18, wherein the first and second lace guides comprise loops of material attached to the footwear upper.

22. The footwear assembly of claim 10, wherein the elastic portion connects the first and second inelastic portions of the footwear upper such that the first and second inelastic portions are coupled by elastic portions of the footwear upper.

23. The footwear assembly of claim 22, wherein the first elastic portion of the shoe upper comprises the lateral side and the second elastic portion of the shoe upper comprises the medial side, wherein the elastic portion spans the heel portion.

24. The footwear assembly of claim 22, wherein the first portion of the shoe upper comprises the lateral side and the second portion of the shoe upper comprises the medial side, wherein the elastic portion spans a throat portion of the footwear upper.

25. The footwear assembly of claim 10, further comprising a plurality of elastic portions incorporated into the lacing system.

26. A footwear assembly comprising:

a footwear upper including a toe box portion, a medial side, a lateral side, and a heel portion, the medial side and the lateral side each extending proximally from the toe box portion to the heel portion;

a lace cable with a first end anchored along a distal outside portion of the medial side and a second end anchored along a distal outside portion of the lateral side;

a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper;

a medial proximal lace guide routing the lace cable from the pattern formed by a medial portion of the plurality of lace guides into a position allowing the lace cable to engage a tightening device disposed within a mid-sole portion;

a lateral proximal lace guide to route the lace cable out of the position allowing the lace cable to engage the tightening device into the pattern formed by a lateral portion of the plurality of lace guides;

a first elastic portion extending between first and second lace guides of the plurality of lace guides;

a first inelastic portion extending along an upper side of the first elastic portion; and a second inelastic portion extending along a lower side of the first elastic portion;

wherein:

a first of the plurality of lace guides is positioned on the first inelastic portion;

a second of the plurality of lace guides is positioned on the second inelastic portion;

the first inelastic portion and the second inelastic portion are inelastically uncoupled from each other at least proximate a heel portion end of the upper; and the first elastic portion connects the medial proximal and lateral proximal lace guides via the first and second inelastic portions across the heel portion of the footwear upper at a posterior-most portion of the footwear upper.

27. A footwear assembly comprising:

a footwear upper including a toe box portion, a medial side, a lateral side, and a heel portion, the medial side and the lateral side each extending proximally from the toe box portion to the heel portion;

a lace cable with a first end anchored along a distal outside portion of the medial side and a second end anchored along a distal outside portion of the lateral side;

a plurality of lace guides distributed along the medial side and the lateral side, each lace guide of the plurality of lace guides adapted to receive a length of the lace cable, wherein the lace cable extends through each of the plurality of lace guides to form a pattern along each of the medial side and lateral side of the footwear upper;

a medial proximal lace guide routing the lace cable from the pattern formed by a medial portion of the plurality of lace guides into a position allowing the lace cable to engage a tightening device disposed within a mid-sole portion;

a lateral proximal lace guide to route the lace cable out of the position allowing the lace cable to engage the tightening device into the pattern formed by a lateral portion of the plurality of lace guides; and a first elastic portion extending between first and second portions of the footwear upper; and wherein a first portion of the plurality of lace guides are mounted to a first portion of the upper and a second portion of the plurality of lace guides are mounted to a second portion of the upper, wherein the first and second portions of the upper are inelastic, uncoupled from each other via inelastic portions of the footwear upper, and separated by the first elastic portion.

* * * * *